US008444046B2

(12) United States Patent
DeBusk et al.

(10) Patent No.: US 8,444,046 B2
(45) **Date of Patent: *May 21, 2013**

(54) CARTON HAVING NOVEL OPENING FEATURES

(75) Inventors: Patrick J. DeBusk, Larue, TX (US); Jean-Manuel Gomes, Marietta, GA (US); Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/493,181

(22) Filed: Jun. 11, 2012

(65) Prior Publication Data

US 2012/0248178 A1 Oct. 4, 2012

Related U.S. Application Data

(63) Continuation of application No. 12/617,742, filed on Nov. 13, 2009, now Pat. No. 8,220,702, which is a continuation of application No. 11/261,258, filed on Oct. 28, 2005, now Pat. No. 7,699,213.

(60) Provisional application No. 60/623,683, filed on Oct. 29, 2004, provisional application No. 60/623,491, filed on Oct. 29, 2004, provisional application No. 60/623,492, filed on Oct. 29, 2004.

(51) Int. Cl.
*B65D 5/72* (2006.01)

(52) U.S. Cl.
USPC ..... 229/122; 206/139; 229/242

(58) Field of Classification Search
USPC ..... 229/122.1, 242, 240; 221/33, 303, 221/302, 305; 206/139, 155, 169
See application file for complete search history.

(56) References Cited

U.S. PATENT DOCUMENTS 902,347 A 10/1908 Tillinghast
1,301,201 A 4/1919 Walker (Continued)

FOREIGN PATENT DOCUMENTS

CA 874828 7/1971
CA 2246020 2/2000

(Continued)

OTHER PUBLICATIONS

"Riverwood" for the Carton Designated as Fridge Pack, International Bottler & Packer, Nov. 2001 [Binstead Publications Limited—United Kingdom].

(Continued)

*Primary Examiner* — Nathan Newhouse
*Assistant Examiner* — Christopher Demeree
(74) *Attorney, Agent, or Firm* — Womble Carlyle Sandridge & Rice, LLP

(57) ABSTRACT

Cartons have dispensing features that enable containers or other articles to be selectively dispensed from the cartons while preventing inadvertent escape of the articles from the cartons. A carton can have an exiting end panel closing an interior space and a dispenser pattern defining a dispenser having a bottom door extending across the exiting end panel. The dispenser pattern can comprise a plurality of tear lines that define a removable portion comprising at least a portion of the exiting end flap, the top panel, and at least one of the first side panel and the second side panel. The dispenser pattern further comprises a pivot line in the bottom panel, a first line, and a second line that are for enabling pivoting of the bottom door about the pivot line.

28 Claims, 20 Drawing Sheets

U.S. PATENT DOCUMENTS

| | | | |
|---|---|---|---|
| 1,434,165 | A | 10/1922 | Ten Eyck |
| 1,480,199 | A | 1/1924 | Durick et al. |
| 1,541,143 | A | 6/1925 | Hoile |
| 1,548,254 | A | 8/1925 | Casey |
| 1,925,102 | A | 9/1933 | Levkoff |
| 2,005,924 | A | 6/1935 | Wilson |
| 2,067,749 | A | 1/1937 | Zimmerman et al. |
| 2,115,673 | A | 4/1938 | Stompe |
| 2,124,808 | A | 7/1938 | White et al. |
| 2,299,027 | A | 10/1942 | Novak |
| 2,312,595 | A | 3/1943 | Smith |
| 2,448,819 | A | 9/1948 | Mitchell |
| 2,473,635 | A | 6/1949 | Buttery |
| 2,669,351 | A | 2/1954 | Carson et al. |
| 2,718,301 | A | 9/1955 | Palmer |
| 2,723,027 | A | 11/1955 | Guyer |
| 2,730,232 | A | 1/1956 | Coe |
| 2,754,047 | A | 7/1956 | Schmidt et al. |
| 2,842,304 | A | 7/1958 | Ringler |
| 2,868,431 | A | 1/1959 | Painter |
| 2,894,672 | A | 7/1959 | Bamburg |
| 2,919,844 | A | 1/1960 | Anderson, Jr. |
| 2,930,516 | A | 3/1960 | Fowle et al. |
| 2,975,891 | A | 3/1961 | Stone |
| 2,990,097 | A | 6/1961 | Thompson |
| 2,996,344 | A | 8/1961 | Garman |
| 3,002,651 | A | 10/1961 | Gauld |
| 3,018,031 | A | 1/1962 | Ahlbor et al. |
| 3,078,032 | A | 2/1963 | Robinson et al. |
| 3,133,634 | A | 5/1964 | Bulovic |
| 3,160,274 | A | 12/1964 | Pritchard |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| RE26,083 | E | 9/1966 | Forrer |
| 3,300,115 | A | 1/1967 | Schauer |
| 3,332,594 | A | 7/1967 | De Capua |
| 3,346,167 | A | 10/1967 | Schmidt |
| 3,356,279 | A | 12/1967 | Root |
| 3,517,858 | A | 6/1970 | Farquhar |
| 3,540,581 | A | 11/1970 | Koolnis |
| 3,599,858 | A | 8/1971 | Samsing |
| 3,669,251 | A | 6/1972 | Phillips, Jr. |
| 3,765,527 | A | 10/1973 | Vargo |
| 3,894,681 | A | 7/1975 | Arneson et al. |
| 3,913,739 | A | 10/1975 | Hennessey |
| 3,942,631 | A | 3/1976 | Sutherland et al. |
| 3,961,706 | A | 6/1976 | Roccaforte et al. |
| 4,000,811 | A | 1/1977 | Hardison et al. |
| D243,508 | S | 3/1977 | Killy |
| 4,030,596 | A | 6/1977 | Snyder et al. |
| 4,155,449 | A | 5/1979 | Bryne |
| D252,259 | S | 7/1979 | Rinehart |
| 4,214,660 | A | 7/1980 | Hunt, Jr. |
| 4,216,861 | A | 8/1980 | Oliff |
| 4,222,485 | A | 9/1980 | Focke |
| 4,256,226 | A | 3/1981 | Stone |
| D263,204 | S | 3/1982 | Dutcher |
| 4,318,474 | A | 3/1982 | Hasegawa |
| 4,325,482 | A | 4/1982 | Feeser |
| 4,331,231 | A | 5/1982 | Boyle |
| 4,364,509 | A | 12/1982 | Holley et al. |
| 4,375,258 | A | 3/1983 | Crayne et al. |
| 4,376,509 | A | 3/1983 | Schaffer |
| 4,378,877 | A | 4/1983 | Botterman et al. |
| D269,068 | S | 5/1983 | Mann, Sr. et al. |
| D270,041 | S | 8/1983 | Vestal |
| 4,396,143 | A | 8/1983 | Killy |
| 4,411,365 | A | 10/1983 | Horikawa et al. |
| 4,416,410 | A | 11/1983 | Herrmann |
| 4,417,655 | A | 11/1983 | Forbes, Jr. |
| 4,417,661 | A | 11/1983 | Roccaforte |
| 4,465,180 | A | 8/1984 | Klygis |
| 4,498,581 | A | 2/1985 | Dutcher |
| 4,577,762 | A | 3/1986 | Kuchenbecker |
| 4,582,199 | A | 4/1986 | Schuster |
| 4,588,084 | A | 5/1986 | Holley, Jr. |
| 4,605,128 | A | 8/1986 | Rieke |
| D286,987 | S | 12/1986 | Golan et al. |
| 4,658,984 | A | 4/1987 | Brunner |
| 4,726,471 | A | 2/1988 | Whately et al. |
| 4,756,419 | A | 7/1988 | Le Bras |
| 4,785,991 | A | 11/1988 | Schuster |
| 4,817,866 | A | 4/1989 | Wonnacott |
| D303,090 | S | 8/1989 | Armor et al. |
| 4,860,944 | A | 8/1989 | Wonnacott |
| 4,871,067 | A | 10/1989 | Valenti |
| 4,890,440 | A | 1/1990 | Romagnoli |
| 4,919,266 | A | 4/1990 | McIntosh, Jr. et al. |
| 4,949,845 | A | 8/1990 | Dixon |
| 4,966,324 | A | 10/1990 | Steel |
| 4,972,991 | A | 11/1990 | Schuster |
| 4,974,771 | A | 12/1990 | Lavery |
| 4,981,253 | A | 1/1991 | Quaintance |
| 5,002,186 | A | 3/1991 | Cooper |
| 5,031,825 | A | 7/1991 | Romagnoli |
| 5,067,615 | A | 11/1991 | Davitian |
| 5,101,642 | A | 4/1992 | Alexandrov |
| 5,123,589 | A | 6/1992 | Cote |
| 5,137,211 | A | 8/1992 | Summer et al. |
| 5,170,934 | A | 12/1992 | Lemoine |
| D332,915 | S | 2/1993 | Hoell et al. |
| 5,219,229 | A | 6/1993 | Sengewald |
| 5,249,681 | A | 10/1993 | Miller |
| 5,277,360 | A | 1/1994 | DeMott |
| 5,279,440 | A | 1/1994 | Fougeres et al. |
| 5,284,292 | A | 2/1994 | Johnson |
| 5,333,734 | A | 8/1994 | Stout et al. |
| 5,368,194 | A | 11/1994 | Oliff et al. |
| 5,425,474 | A | 6/1995 | Dalea et al. |
| 5,427,242 | A | 6/1995 | Oliff et al. |
| 5,465,831 | A | 11/1995 | Smith |
| 5,482,185 | A | 1/1996 | McNaughton |
| 5,505,372 | A | 4/1996 | Edson et al. |
| 5,518,111 | A | 5/1996 | Stout |
| 5,577,612 | A | 11/1996 | Chesson et al. |
| 5,597,114 | A | 1/1997 | Kramedjian et al. |
| 5,622,309 | A | 4/1997 | Matsuda et al. |
| 5,657,872 | A | 8/1997 | Leftwich et al. |
| 5,664,683 | A | 9/1997 | Brody |
| 5,690,213 | A | 11/1997 | Matsumura |
| 5,690,230 | A | 11/1997 | Griffith |
| 5,722,584 | A | 3/1998 | Fujiwara |
| 5,772,030 | A | 6/1998 | Baxter |
| 5,775,574 | A | 7/1998 | Whitnell |
| 5,788,117 | A | 8/1998 | Zimmanck |
| 5,794,778 | A | 8/1998 | Harris |
| 5,826,783 | A | 10/1998 | Stout |
| 5,833,060 | A | 11/1998 | Draghetti et al. |
| 5,833,118 | A | 11/1998 | Weiss |
| 5,873,515 | A | 2/1999 | Dunn et al. |
| 5,875,961 | A | 3/1999 | Stone et al. |
| 5,878,947 | A | 3/1999 | Hoy et al. |
| 5,881,884 | A | 3/1999 | Podosek |
| 5,921,398 | A | 7/1999 | Carroll |
| 5,924,559 | A | 7/1999 | Carrel et al. |
| 5,927,498 | A | 7/1999 | Saam |
| 6,050,402 | A | 4/2000 | Walter |
| 6,105,854 | A | 8/2000 | Spivey et al. |
| D436,859 | S | 1/2001 | Botsford et al. |
| 6,176,419 | B1 | 1/2001 | Holley, Jr. |
| 6,283,293 | B1 | 9/2001 | Lingamfelter |
| D454,784 | S | 3/2002 | Oram |
| 6,386,369 | B2 | 5/2002 | Yuhas et al. |
| 6,409,077 | B1 | 6/2002 | Telesca et al. |
| D459,927 | S | 7/2002 | Flowers et al. |
| 6,435,351 | B1 | 8/2002 | Gibb |
| 6,478,219 | B1 | 11/2002 | Holley, Jr. |
| 6,484,903 | B2 | 11/2002 | Spivey et al. |
| 6,523,959 | B2 | 2/2003 | Lee et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |
| 6,631,803 | B2 | 10/2003 | Rhodes et al. |
| 6,648,475 | B1 | 11/2003 | Roddy et al. |

| | | | |
|---|---|---|---|
| 6,669,083 | B2 | 12/2003 | Bates |
| 6,715,639 | B2 | 4/2004 | Spivey |
| 6,729,475 | B2 | 5/2004 | Yuhas et al. |
| 6,752,262 | B1 | 6/2004 | Boriani et al. |
| 6,769,772 | B2 | 8/2004 | Roddy et al. |
| 6,789,673 | B2 | 9/2004 | Lingamfelter |
| 6,866,185 | B2 | 3/2005 | Harrelson |
| 6,866,186 | B2 | 3/2005 | Fogle et al. |
| 6,866,188 | B2 | 3/2005 | Harrelson |
| 6,896,130 | B2 | 5/2005 | Theelen |
| 6,902,104 | B2 | 6/2005 | Holley, Jr. et al. |
| 6,918,487 | B2 | 7/2005 | Harrelson |
| 6,929,172 | B2 | 8/2005 | Bates et al. |
| 6,959,857 | B2 | 11/2005 | Bates |
| 6,974,072 | B2 | 12/2005 | Harrelson |
| 6,991,107 | B2 | 1/2006 | Harrelson |
| 6,997,316 | B2 | 2/2006 | Sutherland |
| 7,000,803 | B2 | 2/2006 | Miller |
| 7,004,897 | B2 | 2/2006 | Spivey, Sr. |
| 7,048,817 | B1 | 5/2006 | Hammond |
| 7,100,798 | B2 | 9/2006 | Spivey |
| 7,104,435 | B2 | 9/2006 | Holley, Jr. |
| 7,134,593 | B2 | 11/2006 | Harrelson |
| 7,175,047 | B2 | 2/2007 | Spivey |
| 7,207,474 | B2 | 4/2007 | Holley, Jr. |
| 7,225,930 | B2 | 6/2007 | Ford et al. |
| 7,237,674 | B2 | 7/2007 | Auclair |
| 7,328,798 | B2 | 2/2008 | Auclair et al. |
| 7,328,834 | B2 | 2/2008 | Harrelson |
| 7,367,453 | B2 | 5/2008 | Sutherland |
| 7,374,043 | B2 | 5/2008 | Holley, Jr. et al. |
| 7,374,076 | B2 | 5/2008 | Holley, Jr. |
| 7,401,711 | B2 | 7/2008 | Spivey, Sr. |
| 7,478,725 | B2 | 1/2009 | Holley, Jr. |
| 7,523,842 | B2 | 4/2009 | Spivey |
| 7,568,612 | B2 | 8/2009 | Ho Fung et al. |
| 7,604,157 | B2 | 10/2009 | Zammit et al. |
| 7,614,497 | B2 | 11/2009 | Spivey, Sr. |
| 7,621,438 | B2 | 11/2009 | Spivey, Sr. |
| 7,648,060 | B2 | 1/2010 | DeBusk |
| 7,648,061 | B2 | 1/2010 | Zammit et al. |
| 7,673,789 | B2 | 3/2010 | DeBusk et al. |
| 7,699,213 | B2 | 4/2010 | DeBusk et al. |
| 7,703,666 | B2 | 4/2010 | Hand et al. |
| 7,712,653 | B2 | 5/2010 | DeBusk et al. |
| 7,762,451 | B2 | 7/2010 | Harrelson |
| 7,780,003 | B2 | 8/2010 | Harrelson |
| 7,870,994 | B2 | 1/2011 | Spivey, Sr. et al. |
| 8,220,702 | B2 | 7/2012 | DeBusk et al. |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2003/0141313 | A1 | 7/2003 | Bates |
| 2003/0141353 | A1 | 7/2003 | Wilson |
| 2003/0150759 | A1 | 8/2003 | White, Jr. |
| 2003/0192905 | A1 | 10/2003 | Spivey |
| 2003/0192907 | A1 | 10/2003 | Bates |
| 2003/0234285 | A1 | 12/2003 | Bates et al. |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0159671 | A1 | 8/2004 | Spivey |
| 2004/0188277 | A1 | 9/2004 | Auclair |
| 2004/0188300 | A1 | 9/2004 | Sutherland |
| 2004/0188508 | A1 | 9/2004 | Holley et al. |
| 2004/0188509 | A1 | 9/2004 | Holley |
| 2005/0023170 | A1 | 2/2005 | Lingamfelter |
| 2005/0092820 | A1 | 5/2005 | Chekroune |
| 2005/0103650 | A1 | 5/2005 | Auclair et al. |
| 2005/0126947 | A1 | 6/2005 | Holley |
| 2005/0178687 | A1 | 8/2005 | Spivey |
| 2005/0178791 | A1 | 8/2005 | Miller |
| 2005/0189405 | A1 | 9/2005 | Gomes et al. |
| 2005/0224565 | A1 | 10/2005 | Holley |
| 2006/0054522 | A1 | 3/2006 | Kline et al. |
| 2006/0065703 | A1 | 3/2006 | DeBusk et al. |
| 2006/0091191 | A1 | 5/2006 | DeBusk |
| 2006/0091193 | A1 | 5/2006 | DeBusk et al. |
| 2006/0118606 | A1 | 6/2006 | Holley et al. |
| 2006/0131370 | A1 | 6/2006 | Bates |
| 2006/0175386 | A1 | 8/2006 | Holley |
| 2007/0017966 | A1 | 1/2007 | DeBusk et al. |
| 2007/0210144 | A1 | 9/2007 | Brand |
| 2008/0245850 | A1 | 10/2008 | Spivey |

FOREIGN PATENT DOCUMENTS

| | | | |
|---|---|---|---|
| CN | 1133000 | A | 10/1996 |
| CN | 1149545 | A | 5/1997 |
| DE | 2323589 | | 11/1974 |
| DE | 75 10 538 | | 8/1975 |
| DE | 76 06 493 | U1 | 6/1976 |
| DE | 29 33 022 | C2 | 2/1980 |
| DE | 81 35 176.3 | | 5/1982 |
| DE | 85 14 718.4 | | 8/1985 |
| DE | 36 12 594 | A1 | 10/1987 |
| DE | 30 07 769 | A1 | 9/1991 |
| DE | 40 23 043 | A1 | 12/1991 |
| DE | 94 12 885.5 | | 10/1994 |
| DE | 94 13 813.3 | | 10/1994 |
| DE | 295 19 931 | U1 | 2/1996 |
| DE | 296 02 010 | U1 | 3/1996 |
| DE | 299 09 008 | U1 | 9/1999 |
| DE | 694 21 620 | T2 | 4/2000 |
| DE | 20213450 | | 11/2002 |
| EP | 0 235 852 | A2 | 9/1987 |
| EP | 0 342 088 | A1 | 11/1989 |
| EP | 0 659 143 | | 6/1995 |
| EP | 0 752 370 | A2 | 1/1997 |
| EP | 0 849 189 | A1 | 6/1998 |
| EP | 0 936 995 | | 8/1999 |
| EP | 1 060 998 | A2 | 12/2000 |
| FR | 2 549 010 | A1 | 1/1985 |
| FR | 2 716 437 | | 8/1995 |
| GB | 2 186 550 | | 8/1987 |
| GB | 2 189 223 | A | 10/1987 |
| GB | 2 264 101 | A | 8/1993 |
| GB | 0202809 | | 2/2002 |
| JP | 49-18843-01 | | 5/1974 |
| JP | 55-61519 | | 4/1980 |
| JP | 59-147018 | A | 10/1984 |
| JP | 60-190680 | A | 12/1985 |
| JP | 61-7136 | | 3/1986 |
| JP | 63-111422 | A | 7/1988 |
| JP | 2-52676 | | 4/1990 |
| JP | 7-9721 | | 7/1993 |
| JP | 2000-050947 | | 2/2000 |
| JP | 2002-166926 | | 6/2002 |
| JP | 2004-521032 | | 7/2004 |
| WO | WO 88/09750 | | 12/1988 |
| WO | WO 95/01284 | | 1/1995 |
| WO | WO 95/25668 | | 9/1995 |
| WO | WO 96/29260 | A1 | 9/1996 |
| WO | WO 97/21607 | | 6/1997 |
| WO | WO 97/22528 | | 6/1997 |
| WO | WO 98/31593 | A1 | 7/1998 |
| WO | WO 98/38099 | | 9/1998 |
| WO | WO 00/03937 | A1 | 1/2000 |
| WO | WO 00/23334 | | 4/2000 |
| WO | WO 00/71428 | A1 | 11/2000 |
| WO | WO 01/28871 | A1 | 4/2001 |
| WO | WO 02/04302 | A1 | 1/2002 |
| WO | WO 02/47990 | A2 | 6/2002 |
| WO | WO 02/085739 | A1 | 10/2002 |
| WO | WO 03/008277 | A2 | 1/2003 |
| WO | WO 2004/043790 | A2 | 5/2004 |

OTHER PUBLICATIONS

"Coca-Cola Fridge Mate," p. 3 Revise Woolworth's Advertisement wca4000/N1A, 2001.

"Coke Bottler Tests a Slimmer Soda Package," Wall Street Journal B3 (Aug. 10, 2001).

"Passing the Torch," Beverage World, p. 36 (Oct. 2002).

"Dispensing Multipack, Coke Canner Rolls Out 'Fridge-Friendly' Pack," Packaging World, Sep. 2001, p. 2 [Summit Publishing Company—Chicago].
"Hot Hit With Consumers," International Bottler & Packer, Nov. 2001 [Binstead Publications Ltd.].
Office Action dated Jun. 13, 2011, for U.S. Appl. No. 12/617,742.
Amendment A and Response to Office Action dated Sep. 9, 2011, for U.S. Appl. No. 12/617,742.
Office Action dated Dec. 1, 2011, for U.S. Appl. No. 12/617,742.
Response to Final Office Action dated Feb. 28, 2012, for U.S. Appl. No. 12/617,742.
Notice of Allowance and Fee(s) Due dated Mar. 14, 2012, for U.S. Appl. No. 12/617,742.
Part B—Fee(s) Transmittal dated Jun. 11, 2012, for U.S. Appl. No. 12/617,742.
Preliminary Amendment dated Sep. 13, 2006, for U.S. Appl. No. 11/261,258.
Office Action dated Apr. 30, 2008, for U.S. Appl. No. 11/261,258.
Amendment and Response dated Jul. 29, 2008, for U.S. Appl. No. 11/261,258.
Office Action dated Oct. 20, 2008, for U.S. Appl. No. 11/261,258.
Request for Continued Examination (RCE) Transmittal dated Jan. 2, 2009, for U.S. Appl. No. 11/261,258.
Amendment Submitted with RCE dated Jan. 2, 2009, for U.S. Appl. No. 11/261,258.
Office Action dated Feb. 13, 2009, for U.S. Appl. No. 11/261,258.
Amendment dated May 12, 2009, for U.S. Appl. No. 11/261,258.
Office Action dated Aug. 19, 2009, for U.S. Appl. No. 11/261,258.
Amendment Under 37 C.F.R. § 1.116 dated Oct. 1, 2009, for U.S. Appl. No. 11/261,258.
Advisory Action dated Oct. 19, 2009, for U.S. Appl. No. 11/261,258.
Amendment Under 37 C.F.R. § 1.116 dated Oct. 28, 2009, for U.S. Appl. No. 11/261,258.
Notice of Allowance and Fee(s) Due dated Dec. 7, 2009, for U.S. Appl. No. 11/261,258.
Part B—Fee(s) Transmittal dated Mar. 5, 2010, for U.S. Appl. No. 11/261,258.
Issue Notification dated Mar. 31, 2010, for U.S. Appl. No. 11/261,258.

CARTON HAVING NOVEL OPENING FEATURES

CROSS-REFERENCE TO RELATED APPLICATIONS

This application is a continuation of co-pending U.S. patent application Ser. No. 12/617,742, filed Nov. 13, 2009, which application is a continuation of application Ser. No. 11/261,258, filed Oct. 28, 2005, which application claims the benefit of U.S. Provisional Application Nos. 60/623,491, 60/623,492, and 60/623,683, all filed on Oct. 29, 2004.

INCORPORATION BY REFERENCE

The entire disclosures of U.S. patent application Ser. No. 12/617,742, filed Nov. 13, 2009, U.S. patent application Ser. No. 11/261,258, filed Oct. 28, 2005, U.S. Provisional Application Nos. 60/623,491, 60/623,492, and 60/623,683, all filed on Oct. 29, 2004, are hereby incorporated by reference for all purposes as if presented herein in their entireties.

BACKGROUND

Enclosed cartons with dispensing features have been used in the past. Many include a dispenser defining a dispenser. The dispenser is removable from the carton to create an opening from which articles can be removed from the carton. In many instances, after the user engages and opens the dispenser, some of the cans or articles, especially those disposed in lower columns, are positioned below the opening created by the dispenser, rendering removal of cans from the carton difficult.

SUMMARY

According to a first aspect of the invention, a carton includes a bottom door that can be pivoted open to create an opening in the lower part of the dispensing or exiting end of the carton. The bottom door may be formed to provide access to cans or other articles in the carton without unnecessarily weakening the panel or panels in which the bottom door is disposed. The bottom door may also be selectively openable and closeable to prevent inadvertent escape of articles from the carton.

According to a second aspect of the invention, an access aperture is formed in the exiting end panel of carton when the carton dispenser is opened. The access aperture allows articles to be lifted out of the carton without requiring undesirably low dispenser openings in the side panels of the carton.

According to a third aspect of the invention, a carton has a dispenser that leaves a dispenser opening with high side walls. The high side walls provide for a carton of high strength and rigidity after the carton is opened.

Other aspects, features, and details of the present invention can be more completely understood by reference to the following detailed description of exemplary embodiments taken in conjunction with the drawings and from the appended claims.

BRIEF DESCRIPTION OF THE DRAWING FIGURES

DETAILED DESCRIPTION

The present invention generally relates to dispensers for cartons. The dispensers according to present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the invention, the following detailed description describes generally cylindrical beverage containers as disposed within the carton embodiments. In this specification, the terms "lower," "bottom," "upper" and "top" indicate orientations determined in relation to fully erected cartons.

Figure 1:
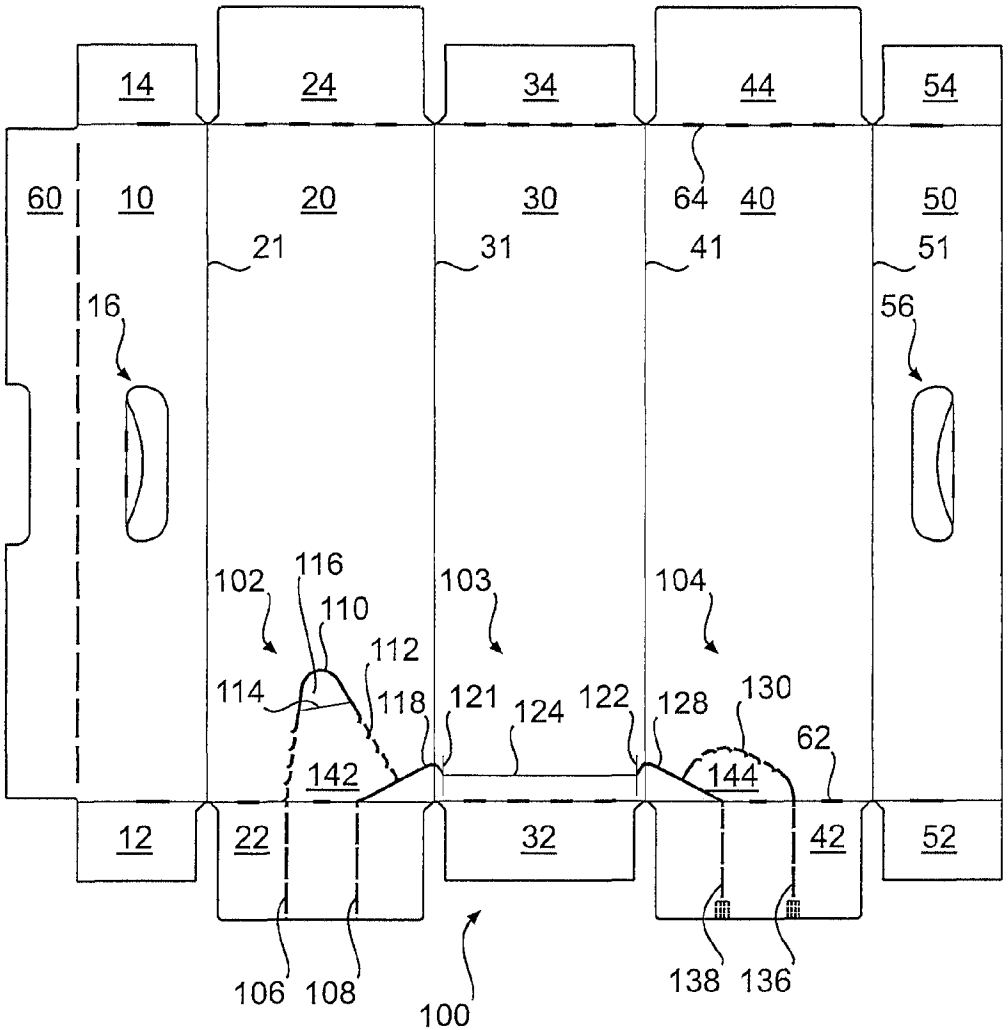
FIG. 1 is a plan view of a blank from which a carton according to a first embodiment of the invention is formed.

FIG. 1 is a plan view of a blank 8 used to form a carton 190 (illustrated in FIG. 2) according to a first embodiment of the invention. The blank 8 comprises a first top panel 10 foldably connected to a first side panel 20 at a first transverse fold line 21, a bottom panel 30 foldably connected to the first side panel 20 at a second transverse fold line 31, a second side panel 40 foldably connected to the bottom panel 30 at a third transverse fold line 41, and a second top panel 50 foldably connected to the second side panel 40 at a fourth transverse fold line 51. An adhesive flap 60 may be foldably connected to the first top panel 10 at a fifth transverse fold line 61. Slotted handle apertures 16, 56 can be included in the first and second top panels 10, 50.

The first top panel 10 is foldably connected to a first top exiting end flap 12 and a first top end flap 14. The first side panel 20 is foldably connected to a first side exiting end flap 22 and a first side end flap 24. The bottom panel 30 is foldably connected to a bottom exiting end flap 32 and a bottom end flap 34. The second side panel 40 is foldably connected to a second side exiting end flap 42 and a second side end flap 44. The second top panel 50 is foldably connected to a second top exiting end flap 52 and a second top end flap 54. The exiting end flaps 12, 22, 32, 42, 52 extend along a first marginal area of the blank 8, and may be foldably connected along a first longitudinally extending fold line 62. The end flaps 14, 24, 34, 44, 54 extend along a second or bottom marginal area of the blank 8, and may be foldably connected along a longitudinally extending fold line 64. The longitudinal fold lines 62, 64 may be straight fold lines, or may be offset at one or more locations to account for, for example, blank thickness. When the carton 190 is erected, the exiting end flaps 12, 22, 32, 42, 52 close a front or exiting end of the carton 190, and the end flaps 14, 24, 34, 44, 54 close a back end of the carton 190.

Figure 2:
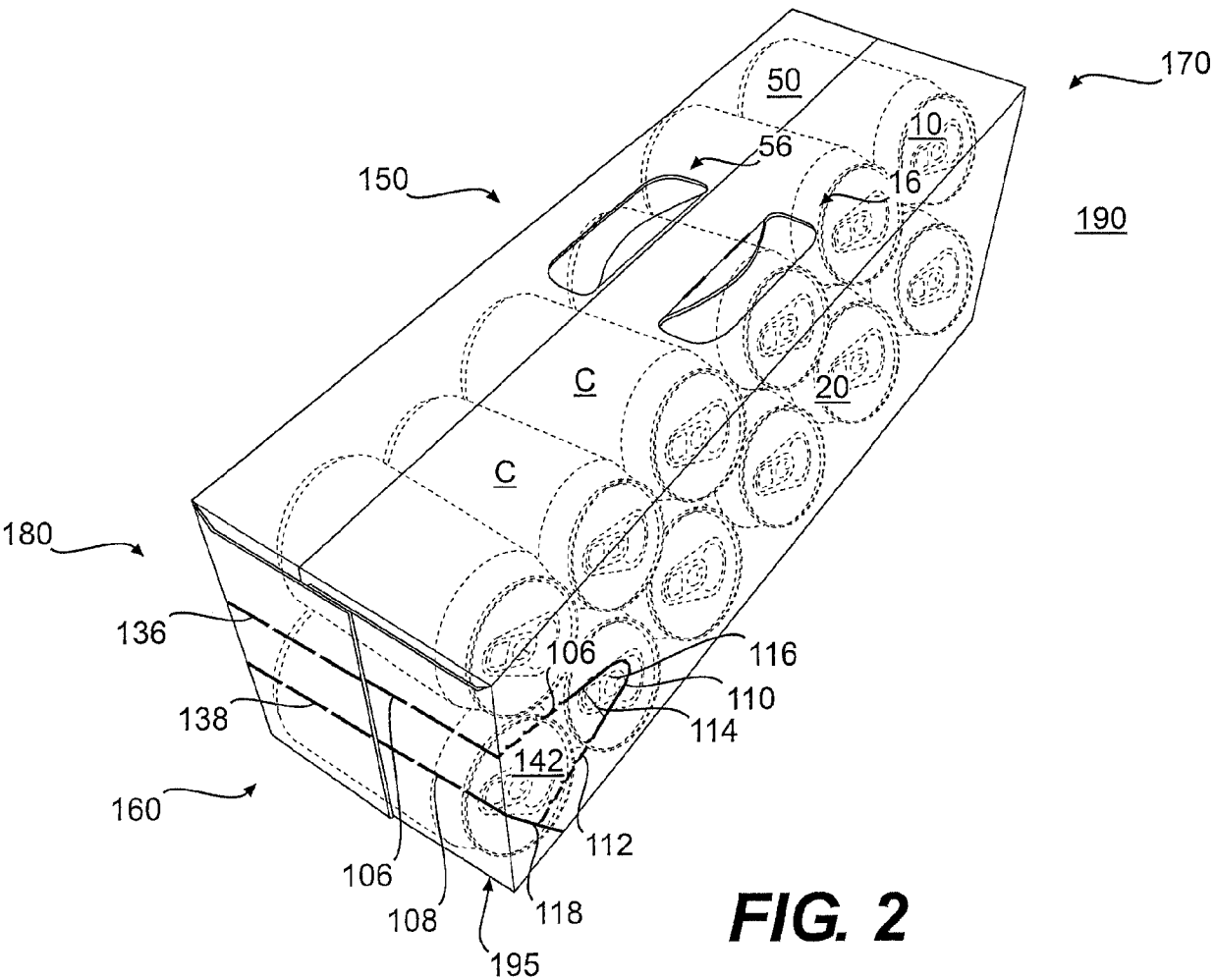
FIG. 2 is a perspective view of the carton according to the first embodiment of the invention.

A dispenser pattern 100 is formed in the blank 8 and defines a dispenser 180 in the erected carton (FIG. 2). The dispenser pattern 100 can generally be formed from tear lines or other lines of disruption that allow all or a portion of the dispenser to be removed. The dispenser pattern 100 comprises a first side dispenser pattern 102, a center dispenser pattern 103, and a second side dispenser pattern 104. The first side dispenser pattern 102 defines a first side dispenser panel 142, and comprises an arcuate opening line 110 and a fold line 114 defining an opening flap or panel 116 in the first side dispenser panel 142. A first generally transversely extending line 106 extends from an upper section of the opening line 110, and a first obliquely extending line 112 extends from a lower section of the opening line 110. A first pivot line 118 extends obliquely through the first side panel 20 adjacent to the first obliquely extending line 112, and a second generally transversely extending line 108 extends from an end of the first pivot line 118 and through the exiting end panel 22.

The second side dispenser pattern 104 defines a second side dispenser panel 144 in the second side panel 40. The second side dispenser pattern 104 comprises an arcuate line 130 and a third generally transversely extending line 136 extending from an upper section of the arcuate line 130. A second pivot line 128 extends obliquely through the second side panel 40 adjacent to an end of the arcuate line 130, and a fourth generally transversely extending line 138 extends from an end of the second pivot line 128 and through the end panel 42.

The center dispenser pattern 103, along with the pivot lines 118, 128 and the transverse lines 108, 138, defines a pivoting or hinged bottom door 195 in the completed carton 190 (FIG. 2). The center dispenser pattern 103 comprises a pivot or hinge fold line 124 with spaced cuts 121, 122 at either end of the fold line 124. The ends of the center dispenser pattern 103 extend adjacent to ends of the first and second pivot lines 118, 128.

FIG. 2 is a perspective view of the erected carton 190. The carton 190 can be erected from the blank 8 by, for example, folding the blank so that the adhesive flap 60 comes into contact with the second top flap 50. To complete the carton 190, the exiting end flaps 12, 22, 32, 42, 52 are folded inwardly and glued or otherwise adhered in place to form an exiting end panel 160, and the end flaps 14, 24, 34, 44, 54 are folded inwardly and glued or otherwise adhered to form an end panel 170. The first and second top panels 10, 50 are joined at the adhesive flap 60 to form a top panel 150. Containers C (shown by hidden lines) may be placed in the carton 190 prior to forming either or both of the end panels 160, 170. In the erected carton 190, the dispenser pattern 100 forms the dispenser 180 having a pivoting bottom door 195.

Figure 3:
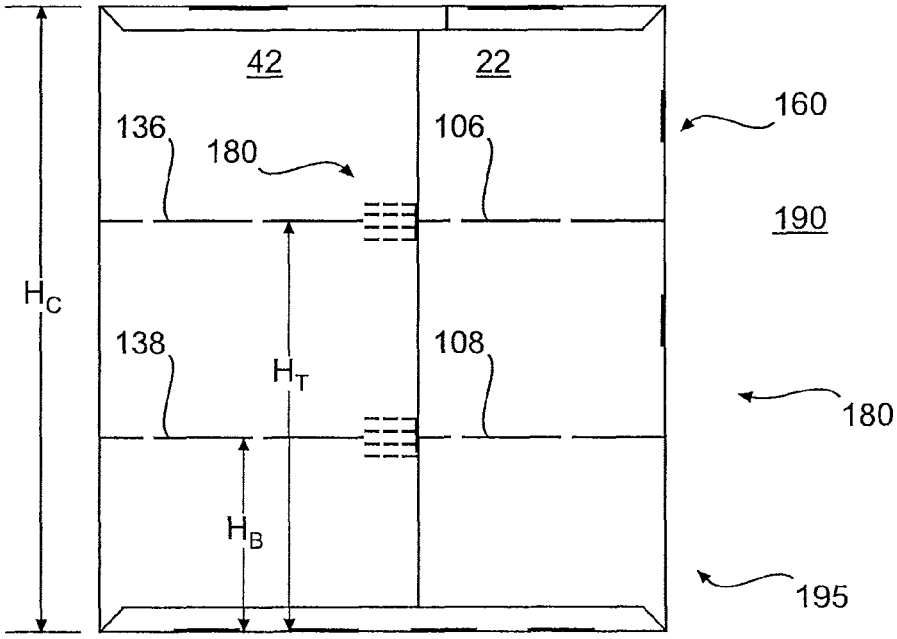
FIG. 3 is an end view of the first carton embodiment.

FIG. 3 is an end view of the carton 190 erected from the blank 8. As shown in FIG. 3, the lines 106, 136 define an upper boundary of the dispenser 180 in the exiting end panel 160, and the lines 108, 138 define a lower boundary or edge of the dispenser 180. The upper or top lines 106, 136 may be disposed at a height $H_T$, and the lower or bottom lines 108, 138 may be disposed at a height $H_B$. The heights $H_T$, $H_B$ may be selected so that a dispenser opening formed by opening the dispenser 180 allows selective removal of containers C from the carton 190. The heights $H_T$, $H_B$ may be selected, for example, as percentage values of the carton height $H_C$, or, as a function of the diameter D of the containers C or some other characteristic dimension of the articles retained within the carton 190.

Figure 4:
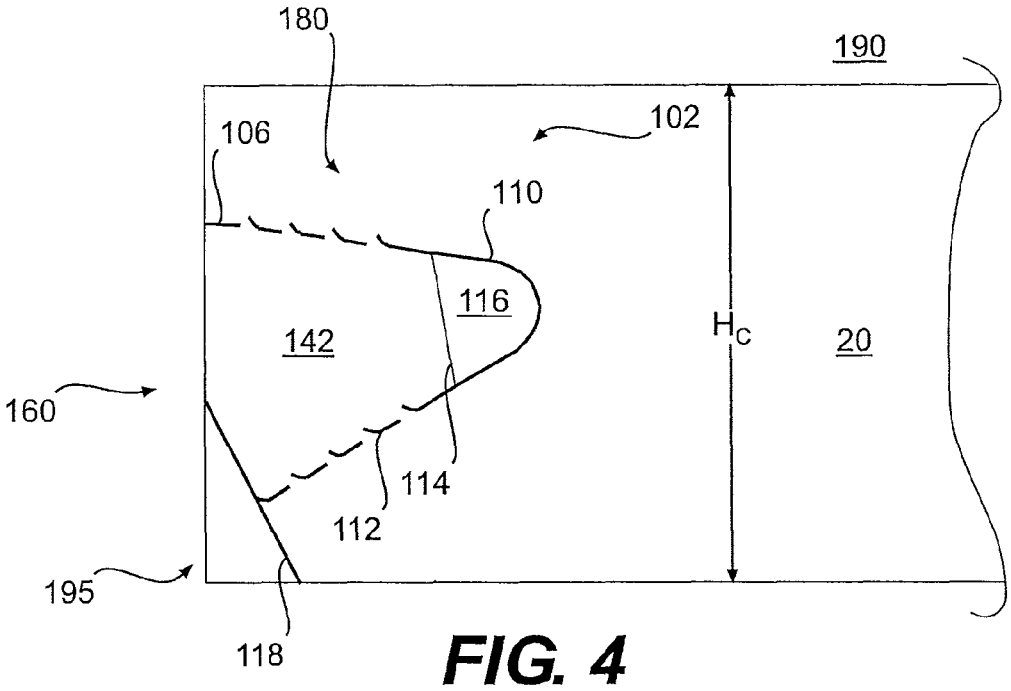
FIG. 4 is a partial right side view of the first carton embodiment.

FIG. 4 is a right side view of the carton 190. The opening flap 116 is disposed in the first side panel 20 to provide an easily accessible location in the carton 190 for opening the dispenser 180. The first obliquely extending line 112 extends downwardly toward the pivot line 118. The lines 106, 112 may be substantially straight, and may provide the first side dispenser panel 142 with a profile that widens progressively toward the exiting end panel 160.

Figure 5:
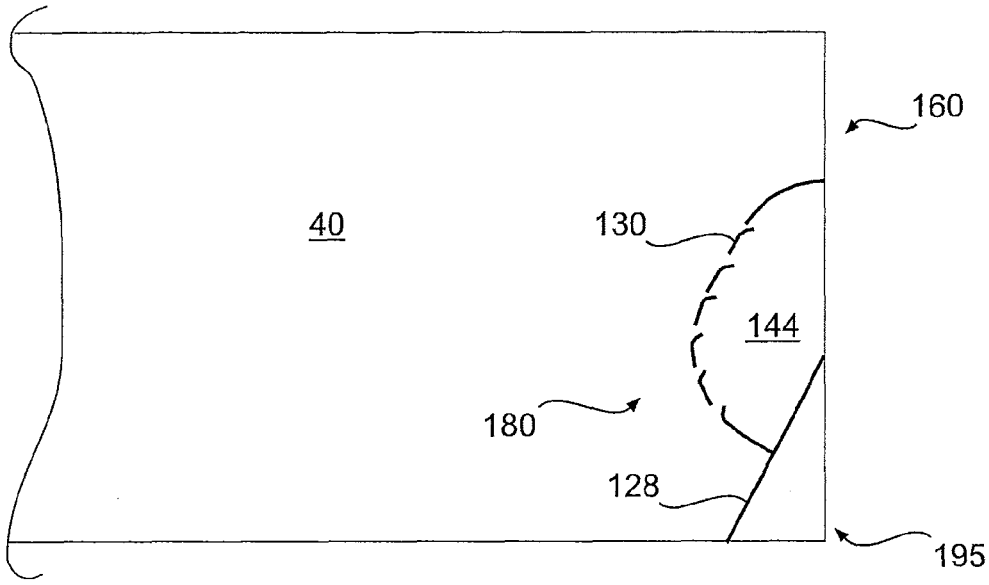
FIG. 5 is a partial left side view of the first carton embodiment.

FIG. 5 is a left side view of the carton 190. The arcuate line 130 provides for an arcuate opening in the second side panel 40 when the dispenser 180 is opened. The second side dispenser panel 144 can widen progressively toward the exiting end panel 160.

Figure 6:
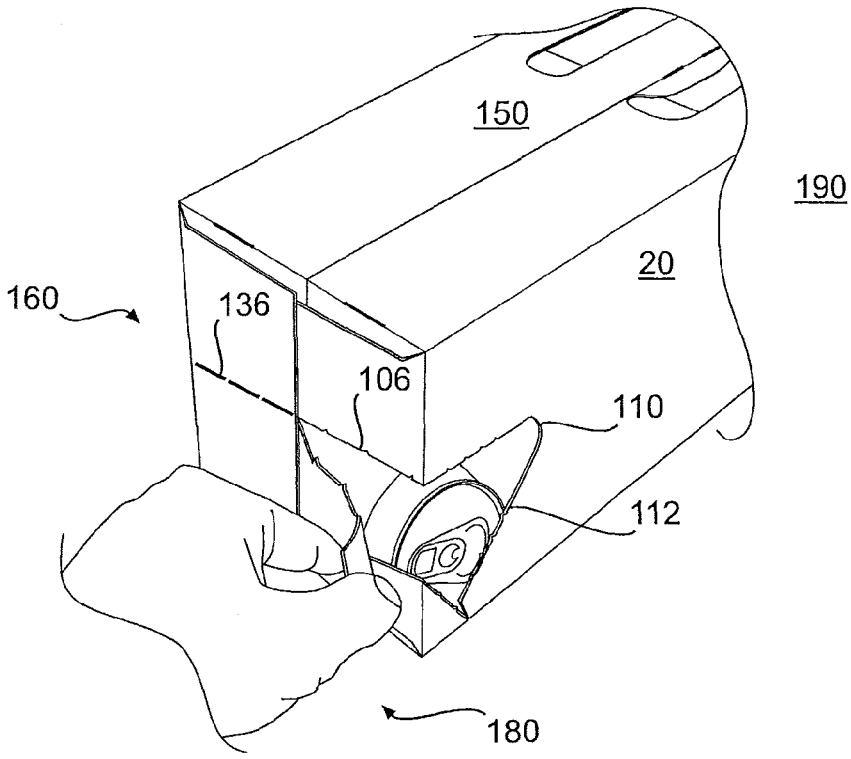
FIG. 6 illustrates opening of the dispenser of the first carton embodiment.
Figure 7:
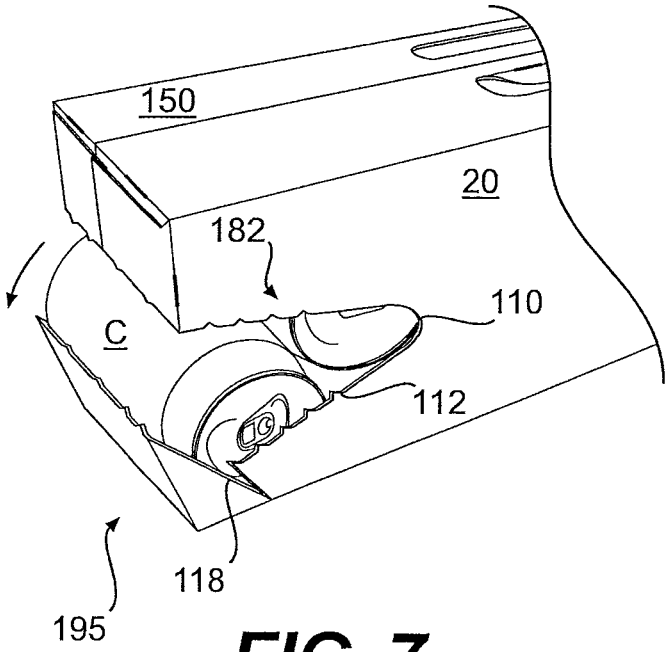
FIGS. 7-8 illustrate the dispenser of the first carton embodiment opened.
Figure 8:
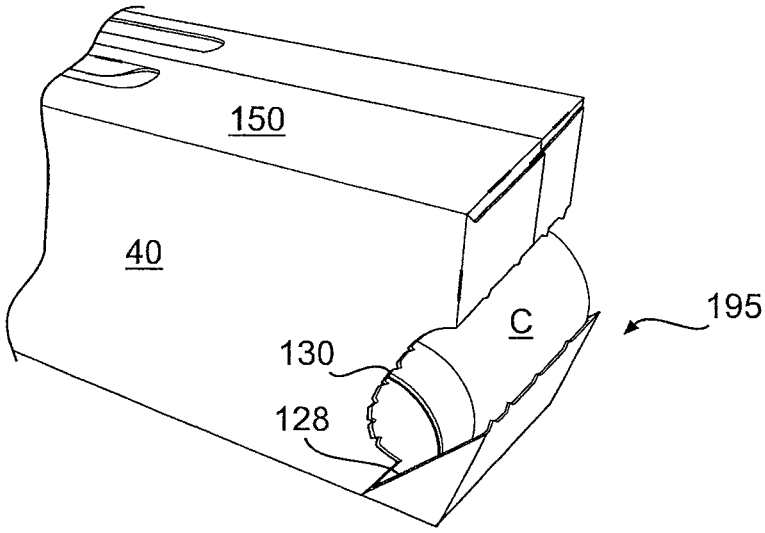

FIGS. 6-8 illustrate opening of the dispenser 180 of the carton 190. Referring to FIG. 6, the carton dispenser 180 is opened by inserting a finger or other object into the opening panel 116. The opening line 110 can be, for example, a continuous cut or a cut interspersed with nicks in order to provide relatively easy access to the opening panel 116. The opening panel 116 may then be pulled so that the carton 190 tears along the lines 112, 106 and the remainder of the first side dispenser panel 142 is removed. The dispenser 180 may then be torn across the exiting end panel 160 along the lines 106, 136 and 108, 138. The lines 106, 136, 108, 138 can be, for example, tear lines.

FIGS. 7 and 8 illustrate the dispenser 180 fully opened after tearing of the dispenser pattern 100 in the second side panel 40, and pivoting the pivoting bottom door 195 outwardly. The pivoting bottom door 195 is pivoted outwardly by partially separating the pivoting bottom door 195 from the remainder of the carton at the lines 118, 128, and 121, 122 (shown in FIG. 1). The lines 118, 128, and 121, 122 can be, for example, continuous cuts or cuts interspersed with nicks to provide for easy pivoting of the bottom door 195.

The bottom door 195 can remain pivotably attached to the carton 190 even after being pivoted outwardly as shown in FIGS. 7 and 8. Also, the bottom door 195 of the carton 190 can be pivoted back into its original 'closed' orientation and provide a stop for the containers C in the enclosed carton 190 in order to selectively prevent inadvertent dispensing of the containers C from the carton 190. The pivoting bottom door 195 may also be, for example, selectively removable from the carton 190. For example, the fold line 124 about which the bottom door 195 pivots may be a tear line, a score line, or a line interspersed with cuts or other perforations that allow the pivoting bottom door 195 to be torn away from the carton.

The bottom door can have any height that allows for selective removal of containers C from the carton 190. In one embodiment, the bottom door 195 has a height (which corresponds to the height $H_B$ in FIG. 3) that is less than the container diameter D, and when pivoted open provides a large enough opening to assist in removal of containers D.

According to the above embodiment, the bottom door 195 allows selective access to articles in the carton 190 when it is pivoted outwardly from the exiting end panel 160. The bottom door 195 can also be pivoted back toward the exiting end panel 160 to partially close the opening formed by the dispenser 180, thereby preventing articles from inadvertently escaping the carton 190. In one application, the edge of the exiting end of the carton 190 can hang over the edge of a supporting surface (e.g., a shelf in a refrigerator, a table, or other surface), allowing the bottom door 195 to easily pivot open. The bottom door 195 can therefore be selectively pivoted open to allow removal of articles from the carton 190. The resiliency of the carton material at the hinged connection of the bottom door 195 to the remainder of the carton 190 can be selected to enable the bottom door 195 to return to a partially closed position after dispensing.

As shown in FIGS. 7 and 8, in the carton 150, the dispenser pattern 100 extends to a relatively sharp angle at the opening flap 116 in the first side panel 20. In the second side panel 40, the dispenser pattern 100 has a wider arcuate profile. The relatively narrow portion of the dispenser pattern 100 in the second side panel 20 provides for more reliable opening of the dispenser 100, while the relatively wide arcuate profile in the second side panel 40 provides for easy access to articles in the carton.

Figure 9:
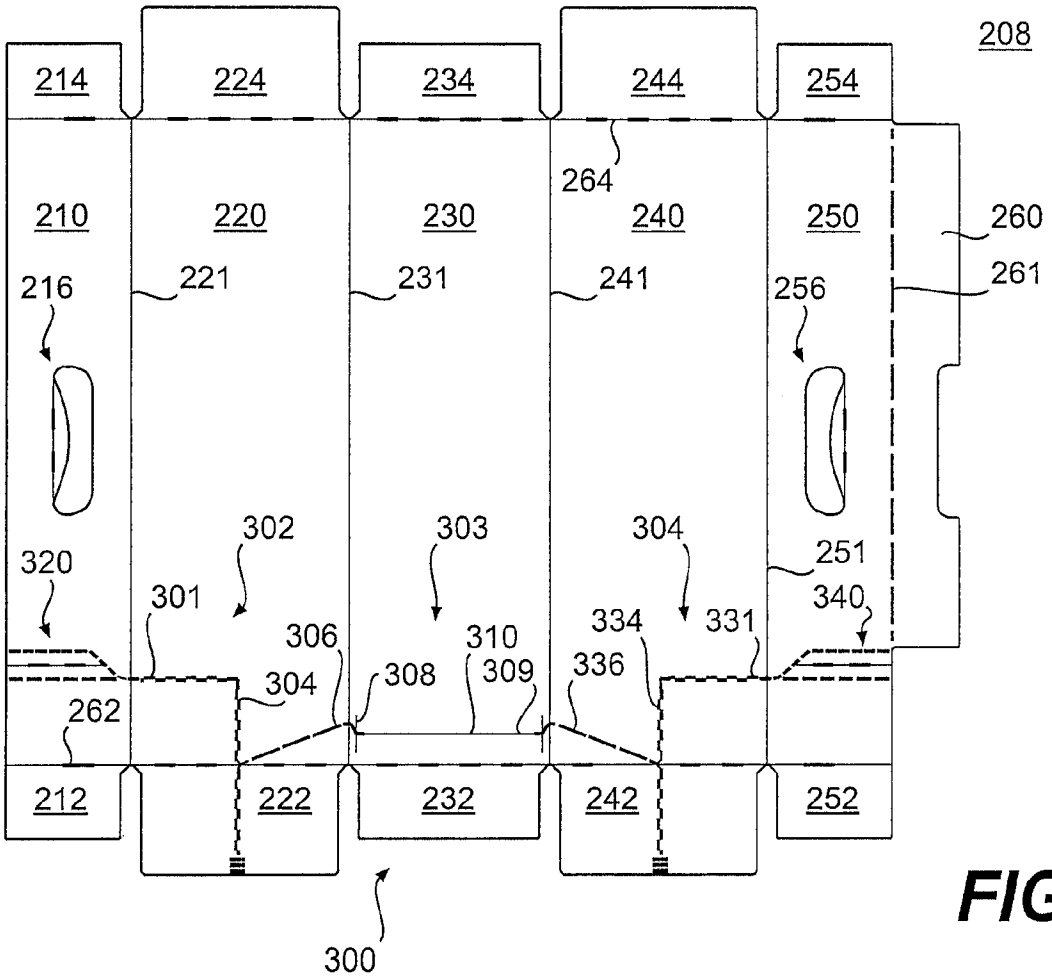
FIG. 9 is a plan view of a blank from which a carton according to a second embodiment of the invention is formed.

FIG. 9 is a plan view of a blank 208 used to form a carton 390 (illustrated in FIG. 10) according to a second embodiment of the invention. The blank 208 comprises a first top panel 210 foldably connected to a first side panel 220 at a first transverse fold line 221, a bottom panel 230 foldably connected to the first side panel 220 at a second transverse fold line 231, a second side panel 240 foldably connected to the bottom panel 230 at a third transverse fold line 241, and a second top panel 250 foldably connected to the second side panel 240 at a fourth transverse fold line 251. An adhesive flap 260 may be foldably connected to the first top panel 210 at a fifth transverse fold line 261. Slotted handle apertures 216, 256 can be included in the first and second top panels 210, 250. The carton 390 may, for example, be generally similar in shape, function and erection to the carton 190, and like or similar reference numbers in the figures illustrating the two embodiments may indicate like or similar elements.

Figure 10:
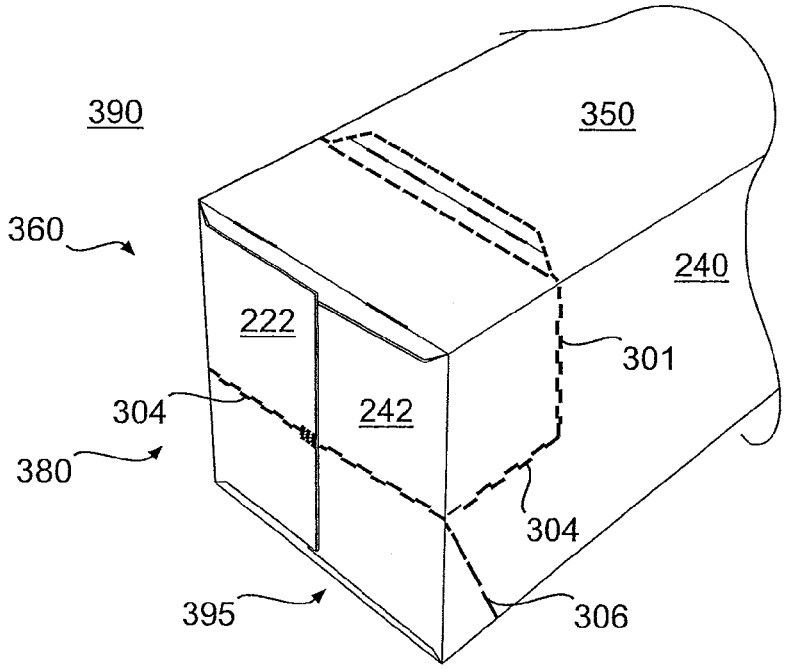
FIG. 10 is a partial perspective view of the carton according to the second embodiment of the invention.

A dispenser pattern 300 is formed in the blank 208 that defines a dispenser 380 in the erected carton 390 (FIG. 10). The dispenser pattern 300 can generally be formed from tear lines or other lines of disruption that allow all or a portion of the dispenser to be removed. The dispenser pattern 300 comprises a first side dispenser pattern 302, a center dispenser pattern 303, and a second side dispenser pattern 304. The first side dispenser pattern 302 comprises a first generally longitudinally extending line 301 and a first generally transversely extending line 304. A first obliquely extending pivot line 306 extends from a point adjacent to the line 304 and the fold line 262. A first opening section 320 may be formed in the first top panel 210. The second side dispenser pattern 304 may include a second generally longitudinally extending line 331, a second generally transversely extending line 334, and a second opening section 340, and may generally be a mirror image of the first side dispenser pattern 302.

The center dispenser pattern 303, along with the pivot lines 306, 336 and the lines 304, 334, defines a pivoting bottom door 395 in the completed carton 390 (illustrated in FIG. 10). The center dispenser pattern 303 comprises a pivot or hinge fold line 310 with spaced cuts 308, 309 located at opposite end of the fold line 310. The ends of the center dispenser pattern 303 extend adjacent to ends of the pivot lines 306, 336.

Figure 11:
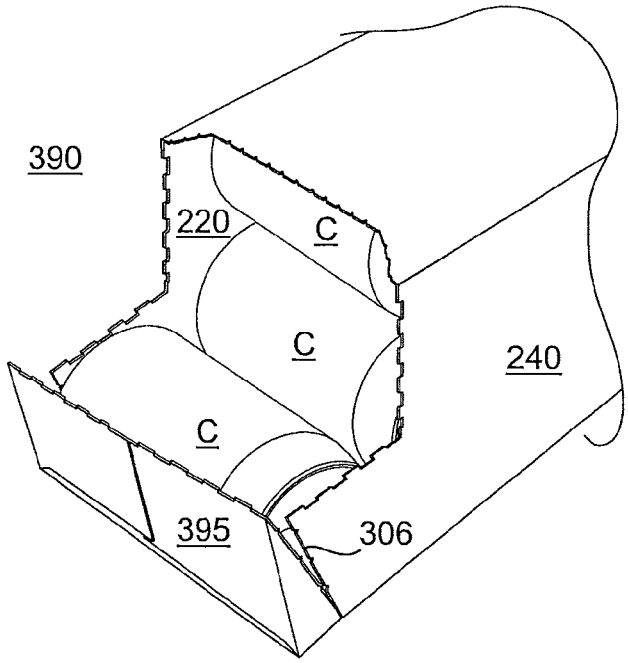
FIG. 11 illustrates the dispenser of the second carton embodiment opened.

FIG. 10 is a partial perspective view of exiting end of the carton 390 erected from the blank 208. In the erected carton 390, the dispenser pattern 300 forms the dispenser 380 having the pivoting bottom door 395, and the first and second opening sections 320, 340 are joined to form an opening section 352 in the top panel 350. Referring also to FIG. 11, the dispenser 380 may be opened by inserting a finger or other object or tool into the opening section 352, and tearing the dispenser 380 open along the lines 301, 304 and 331, 334 (illustrated in FIG. 9) to create generally rectangular profile openings in the side panels 220, 240 and in the exiting end panel 360. The pivoting bottom door 395 is pivoted by partially separating the pivoting bottom door 395 from the remainder of the carton 390 along the lines 306, 336 and 308, 309 (shown in FIG. 9). The lines 306, 336 and 308, 309 can be, for example, continuous cuts or a cut interspersed with nicks to provide for easy pivoting of the bottom door 395. FIG. 11 illustrates the dispenser 380 opened with the bottom door 395 pivoted outwardly.

The pivoting bottom door 395 can be selectively pivoted outwardly to provide ease of access to the containers C through the dispenser opening, and inwardly to prevent the containers from exiting the carton 390. The resiliency of the material used to form the carton 390 can be selected to provide a self-closing or restoring bottom door 395.

The pivoting bottom door 395 may also be selectively removable from the carton 390. For example, the fold line 310 (shown in FIG. 9) may be a tear line, a score line, or a line interspersed with cuts or other perforations that allow the pivoting bottom door 395 to be torn away.

Figure 12:
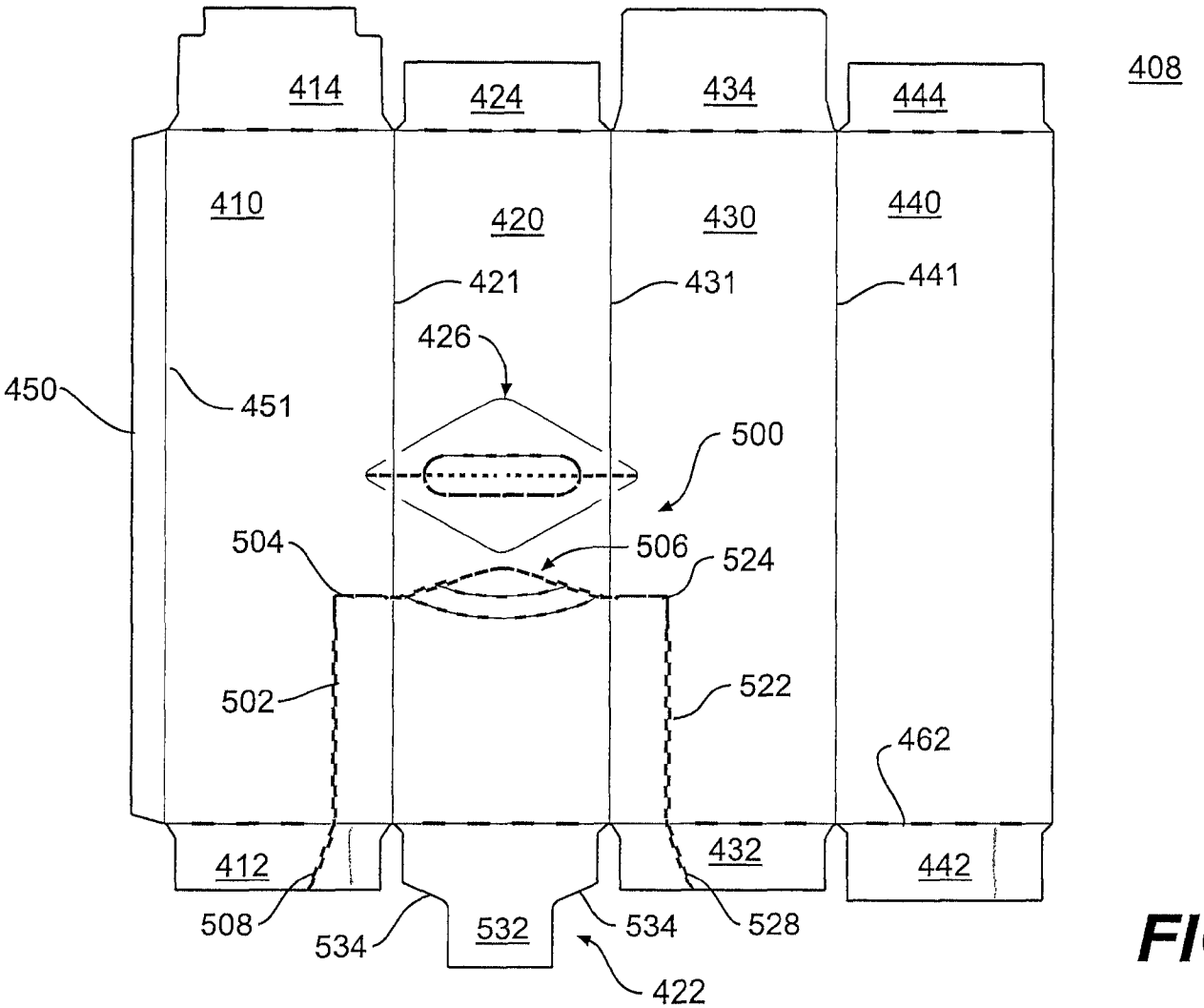
FIG. 12 is a plan view of a blank from which a carton according to a third embodiment of the invention is formed.

FIG. 12 is a plan view of a blank 408 used to form a carton 590 (illustrated in FIG. 13) according to a third embodiment of the invention. The blank 408 comprises a first side panel 410 foldably connected to a top panel 420 at a first transverse fold line 421, a second side panel 430 foldably connected to the top panel 420 at a second transverse fold line 431, and a bottom panel 440 foldably connected to the second side panel 430 at a third transverse fold line 441. An adhesive panel 450 can be foldably connected to the first side panel 410 at a fourth transverse fold line 451. The blank 408 may include a slotted handle 426 in the top panel 420.

The first panel 410 is foldably connected to a first side exiting end flap 412 and a first side end flap 414. The top panel 420 is foldably connected to a top exiting end flap 422 and top end flap 424. The second side panel 430 is foldably connected to a second side exiting end flap 432 and a second side end flap 434. The bottom panel 440 is foldably connected to a bottom exiting end flap 442 and a bottom end flap 444. The exiting end flaps 412, 422, 432, 442 extend along a first marginal area of the blank 408, and may be foldably connected along a first longitudinally extending fold line 462. The end flaps 414, 424, 434, 444 extend along a second or bottom marginal area of the blank 408, and may be foldably connected along a longitudinally extending fold line 464. The longitudinal fold lines 462, 464 may be straight fold lines, or may be offset at one or more locations to account for, for example, blank thickness. When the carton 590 is erected (FIG. 13), the exiting end flaps 412, 422, 432, 442 close a front or exiting end of the carton 590, and the end flaps 414, 424, 434, 444 close back end of the carton 590.

Figure 13:
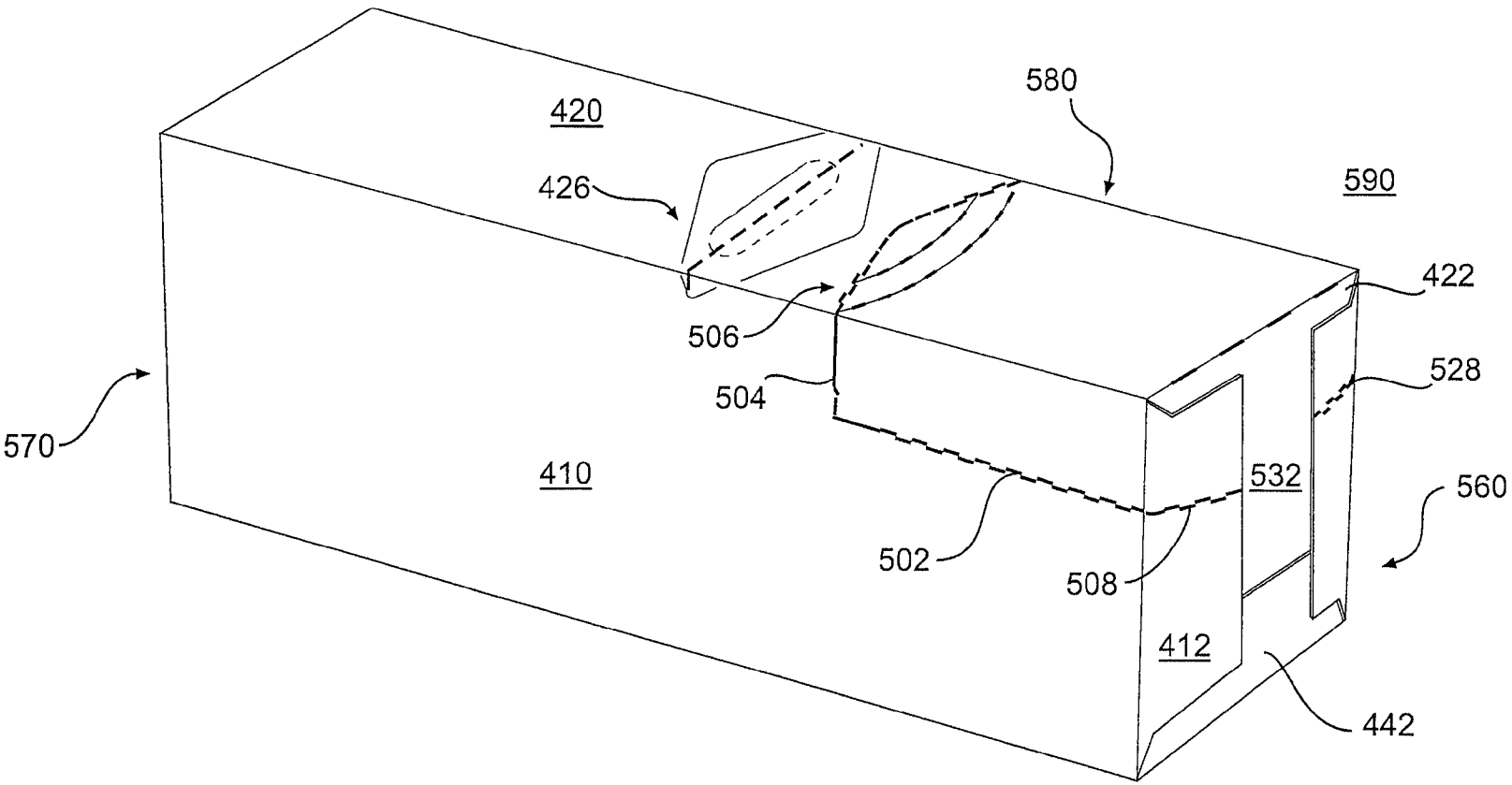
FIG. 13 is a perspective view of the carton according to the third embodiment of the invention.

A dispenser pattern 500 is formed in the blank 408 that defines a dispenser 580 in the erected carton 590 (FIG. 13). The dispenser pattern 500 can generally be formed from tear lines or other lines of disruption that allow all or a portion of the dispenser to be removed. The dispenser pattern 500 comprises first and second generally transversely extending lines 502, 522, and first and second generally longitudinally extending lines 504, 524. An opening section 506 may connect the longitudinally extending lines 504, 524 and provides an opening point for the dispenser 580. A first oblique line 508 extends from an end of the transverse line 502 and through the exiting end flap 412. A second oblique line 528 extends from an end of the transverse line 522 and through the exiting end flap 432.

The exiting end flap 422 disposed within the dispenser pattern 500 extends an additional distance in the lateral or transverse direction of the blank 408, beyond the edges of the other exiting end flaps 412, 432, 442. The exiting end flap 422 terminates at a section 532 of reduced width, which is adjacent to beveled or sloped edges 534. The function of the exiting end flap 422 is discussed in detail below with reference to FIGS. 13-17.

FIG. 13 is a perspective view of the carton 590 erected from the blank 408. The carton 590 can be erected from the blank 408 by, for example, folding the blank 408 so that the adhesive flap 450 comes into contact with the bottom panel 440. To complete the carton 590, the exiting end flaps 412, 422, 432, 442 are folded inwardly and glued or otherwise adhered in place to form an exiting end panel 560, and the end flaps 414, 424, 434, 444 are folded inwardly and glued or otherwise adhered to form an end panel 570. Containers C may be placed in the carton 590 prior to forming either or both of the end panels 560, 570. In the erected carton 590, the dispenser pattern 500 forms the dispenser 580.

Figure 14:
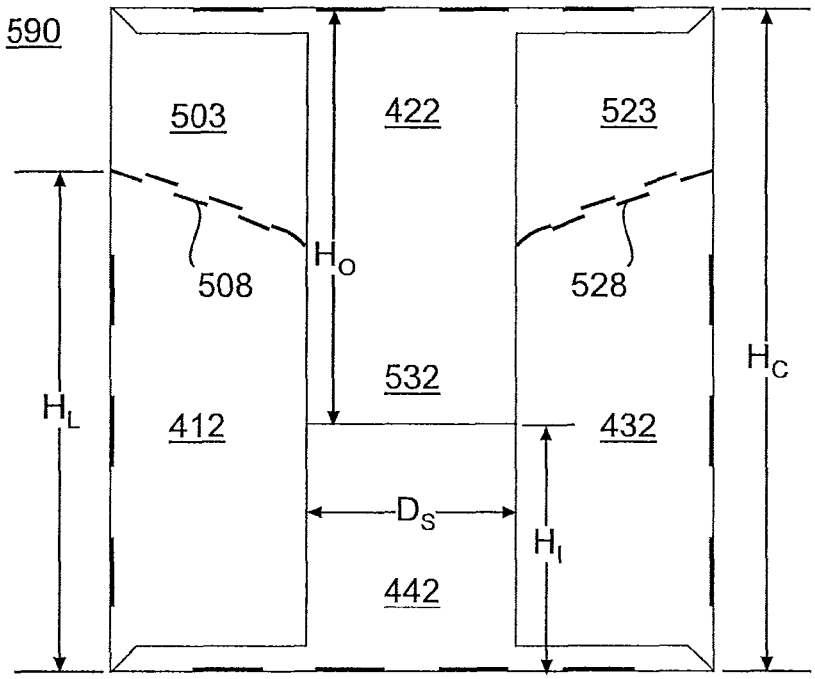
FIG. 14 is an end view of the third carton embodiment.
Figure 17:
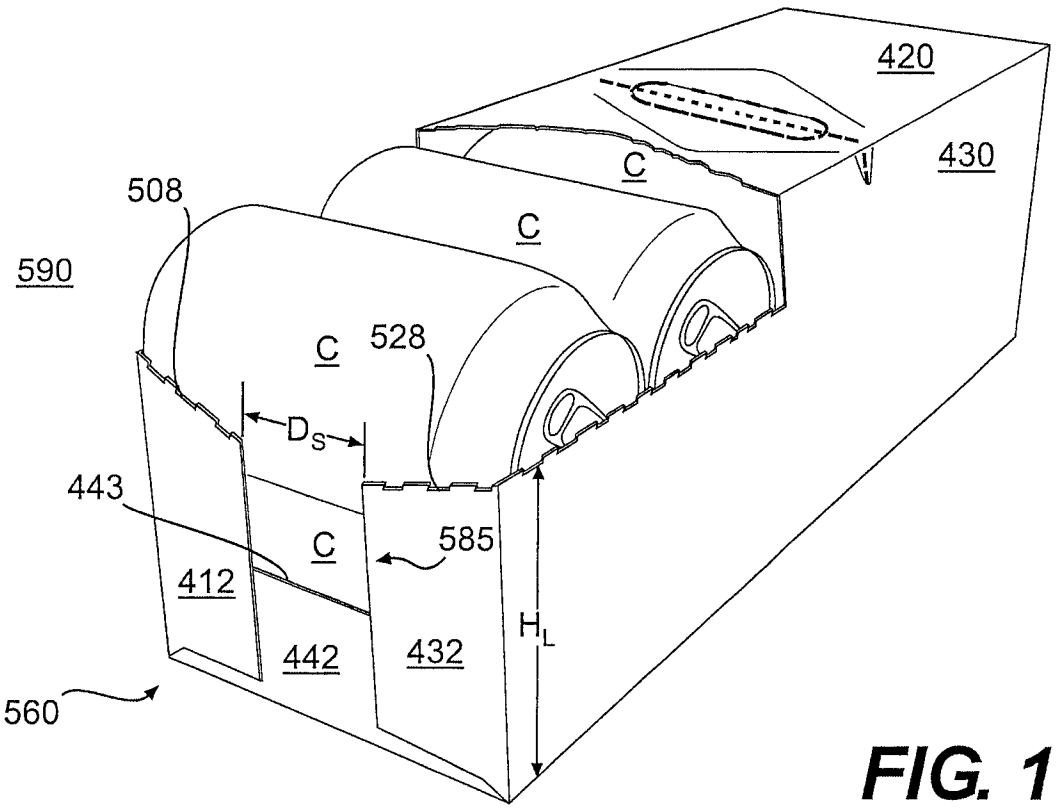
FIG. 17 illustrates the dispenser of the third carton embodiment opened.

FIG. 14 is an end view of the carton 590. As shown in FIG. 14, the bottom exiting end flap 442 extends upwardly a height $H_1$ to create a flap opening height $H_O$ when the dispenser 580 is opened (FIG. 17). The first and second side end flaps 412, 432 may each extend toward the center of the exiting end panel 560 so that they do not meet. A separation distance $D_S$ therefore exists between the exiting end flaps 412, 432 that exposes a portion of the exiting end flap 422, including a portion of the section 532. The separation distance $D_S$ arises because the length of the top panel 420 measured along a longitudinal direction of the blank 408 (FIG. 12) is greater than a sum of the lengths of the first and second side exiting end flaps 412, 432 measured along a transverse direction of the blank 408. The lines 508, 528 define first and second removable end panel section 503, 523 in upper portions of the side exiting end panels 412, 432, respectively.

Figure 15:
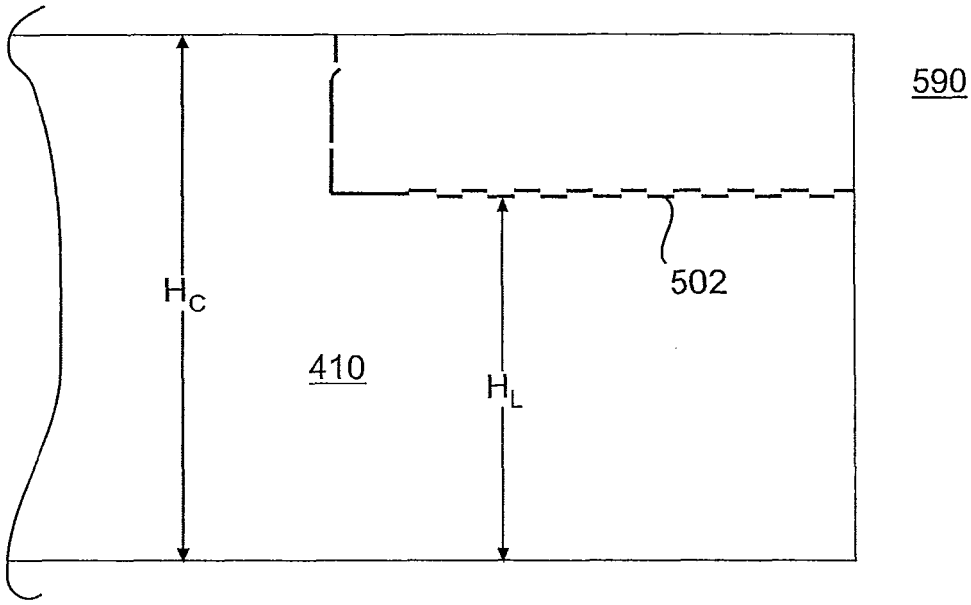
FIG. 15 is a partial side view of the third carton embodiment.

The side exiting end panel flaps 412, 432 may be adhered to the top exiting end flap 422 at the end panel sections 503, 523, with the remainder of the exiting end flaps 412, 432 not being attached to the exiting end flap 422. This method of adhering the side exiting end panel flaps 412, 432 provides for the removal of the end panel sections 503, 523 upon opening of the dispense 580. Bottom portions of the side end panel flaps 412, 432 may be adhered to the bottom exiting end flap 442. FIG. 15 is a side view of the carton 590. As shown in FIGS. 14 and 15, the lines 502, 522 are disposed at a height $H_L$.

Figure 16:
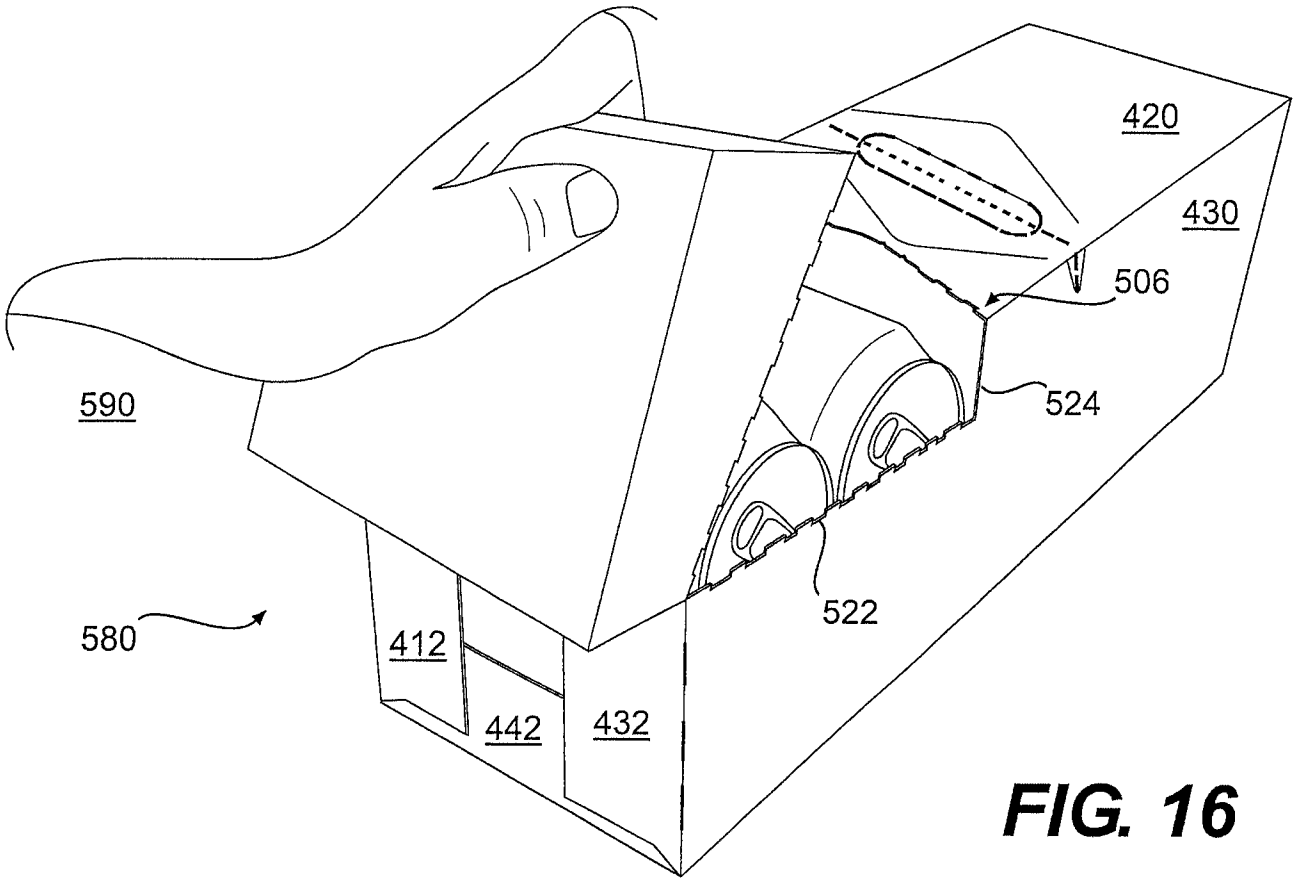
FIG. 16 illustrates opening of the dispenser of the third carton embodiment.

FIG. 16 is a perspective view of the dispenser 580 being opened. Opening may be begun by pressing downwardly on the top panel 420 at the opening section 506, and tearing along the lines 502, 504 (shown in FIG. 12) and 522, 524. Referring to FIG. 17, the dispenser 580 is further torn along the first and second lines 508, 528, which extend through the end panels 412, 432, to fully open the dispenser 580. Opening the dispenser 580 creates an access aperture 585 between the exiting end flaps 412, 432 and above the end flap 442.

Referring to FIG. 17, the height $H_L$ of the bottom edge of the side of the dispenser opening can be selected such that an upper column of the containers C can be accessed from the sides of the dispenser opening. Alternatively, the height $H_L$ can extend to the top panel 420 so that $H_L$ equals the carton height $H_C$, and articles can be dispensed through the opening in the top panel 420 and the end panel 560. For example, the height $H_L$ can be in the range of about 105-200% of the container diameter D. In other embodiments, the height $H_L$ can be in the range of about 130-180% of the container diameter D. The carton height $H_C$ can generally be an integral multiple of container diameter D.

Referring to FIGS. 14 and 17, the height $H_1$ of the upper edge of the bottom exiting end flap 442 can be selected to be sufficiently low in the exiting end panel 560 so that containers C in each column of containers can be accessed through the opened exiting end panel 560. The height $H_1$ can, for example, be in the range of about 10%-90% of container diameter D. The separation distance $D_S$ may be selected so that a finger or other object can be inserted through the access aperture 585 to lift a container out of the carton 590. The separation distance $D_S$ can have a minimum value of at least about ⅜".

The exiting end flap 422 can, for example, have a length sufficient to fully cover the space between the exiting end flaps 412, 432, 442, which spans the distance $D_S$ in the unopened carton 590. The length of the exiting end flap 422, measured from the fold line 462 in FIG. 12, can be at least about 110% of container diameter D.

According to the above embodiment, the access aperture 585 allows removal of articles from the carton 590 regardless of the height of the dispenser opening in the side panels. The carton 590 may be exceptionally rigid because the dispenser opening size may therefore be reduced.

Figure 18:
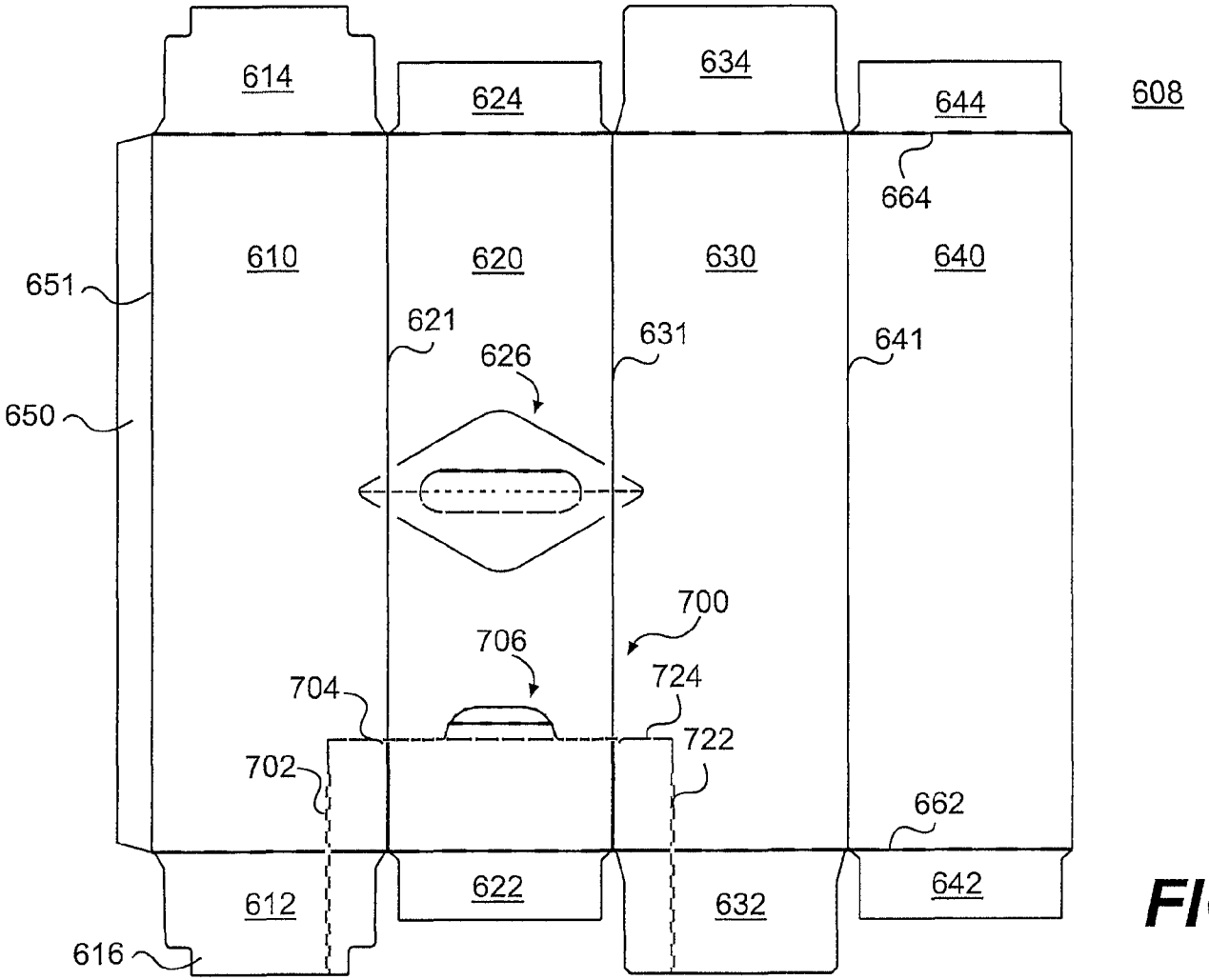
FIG. 18 is a plan view of a blank from which a carton according to a fourth embodiment of the invention is formed.

FIG. 18 is a plan view of a blank 608 used to form a carton 790 (illustrated in FIG. 19) according to a fourth embodiment of the invention. The blank 608 comprises a first side panel 610 foldably connected to a top panel 620 at a first transverse fold line 621, a second side panel 630 foldably connected to the top panel 620 at a second transverse fold line 631, and a bottom panel 640 foldably connected to the second side panel 630 at a third transverse fold line 641. An adhesive panel 650 can be foldably connected to the first side panel 610 at a fourth transverse fold line 651. The blank 608 may include a slotted handle 626 in the top panel 620. The carton 790 may, for example, be generally similar in shape, function and erection to the carton 590, and like or similar reference numbers in the figures illustrating the two embodiments may indicate like or similar elements.

Figure 19:
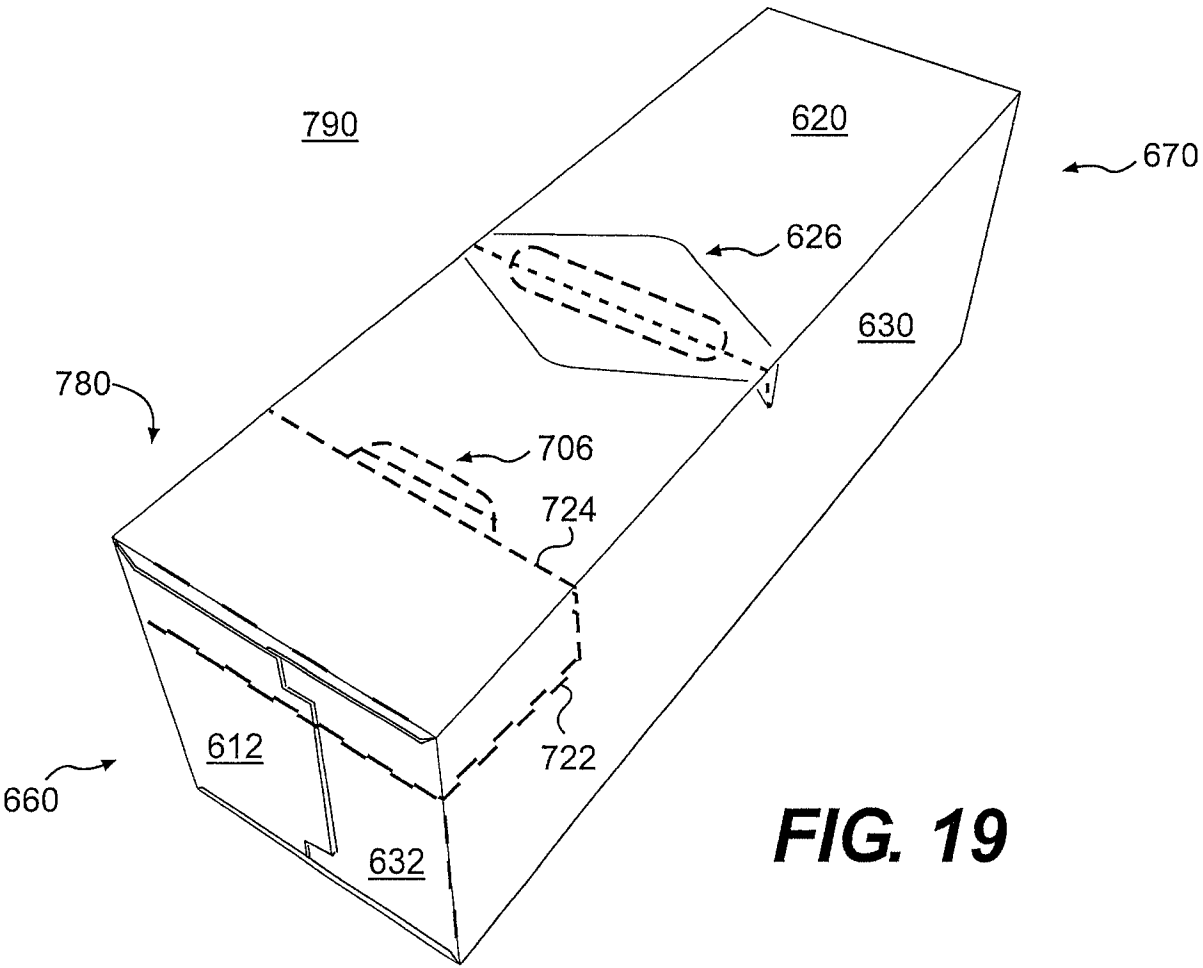
FIG. 19 is a perspective view of the carton according to the fourth embodiment of the invention.

The blank 608 includes a dispenser pattern 700 that defines a dispenser 780 in the erected carton 790 (FIG. 19). The dispenser pattern 700 includes first and second generally transversely extending lines 702, 722, and first and second generally longitudinally extending lines 704, 724. The first and second generally transversely extending lines 702, 722 extend through the side panels 610, 630 and into the exiting end flaps 612, 632, respectively. An opening section 706 may connect the longitudinally extending lines 704, 724, and provides an opening point for the dispenser 780.

Figure 20:
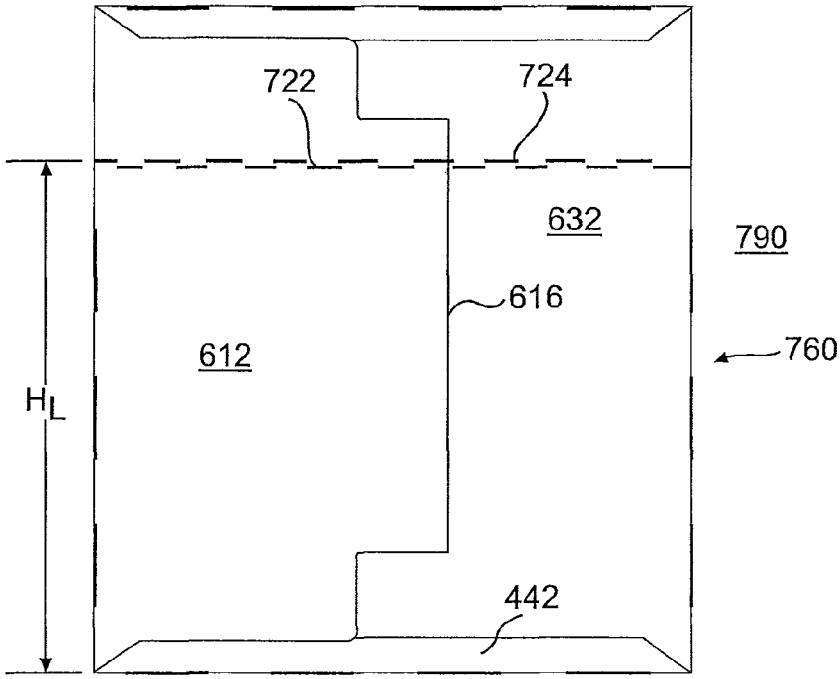
FIG. 20 is an end view of the fourth carton embodiment.

FIG. 20 is a perspective of the carton 790 erected from the blank 608. The carton 790 can be erected from the blank 608 by folding the blank 608 so that the adhesive flap 650 comes into contact with the bottom panel 640, folding and adhering the exiting end flaps 612, 622, 632, 642 to form an exiting end panel 760, and folding and adhering the end flaps 614, 624, 634, 644 to form an end panel 770. Containers C may be placed in the carton 790 at any time prior to forming either or both of the end panels 760, 770. In the erected carton 790, the dispenser pattern 700 forms the dispenser 780.

Figure 21:
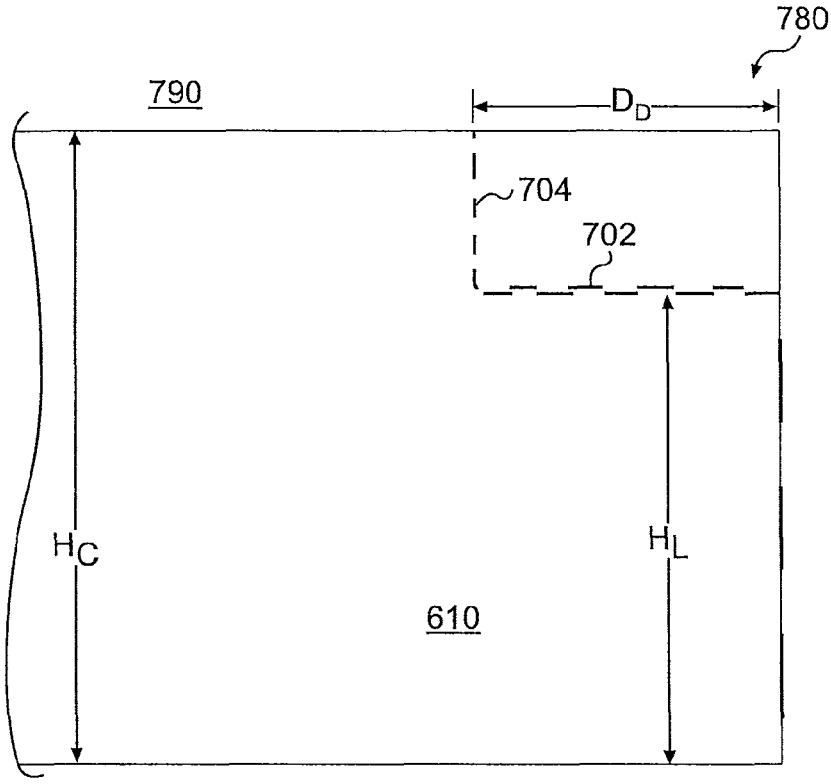
FIG. 21 is a side view of the fourth carton embodiment.
Figure 22:
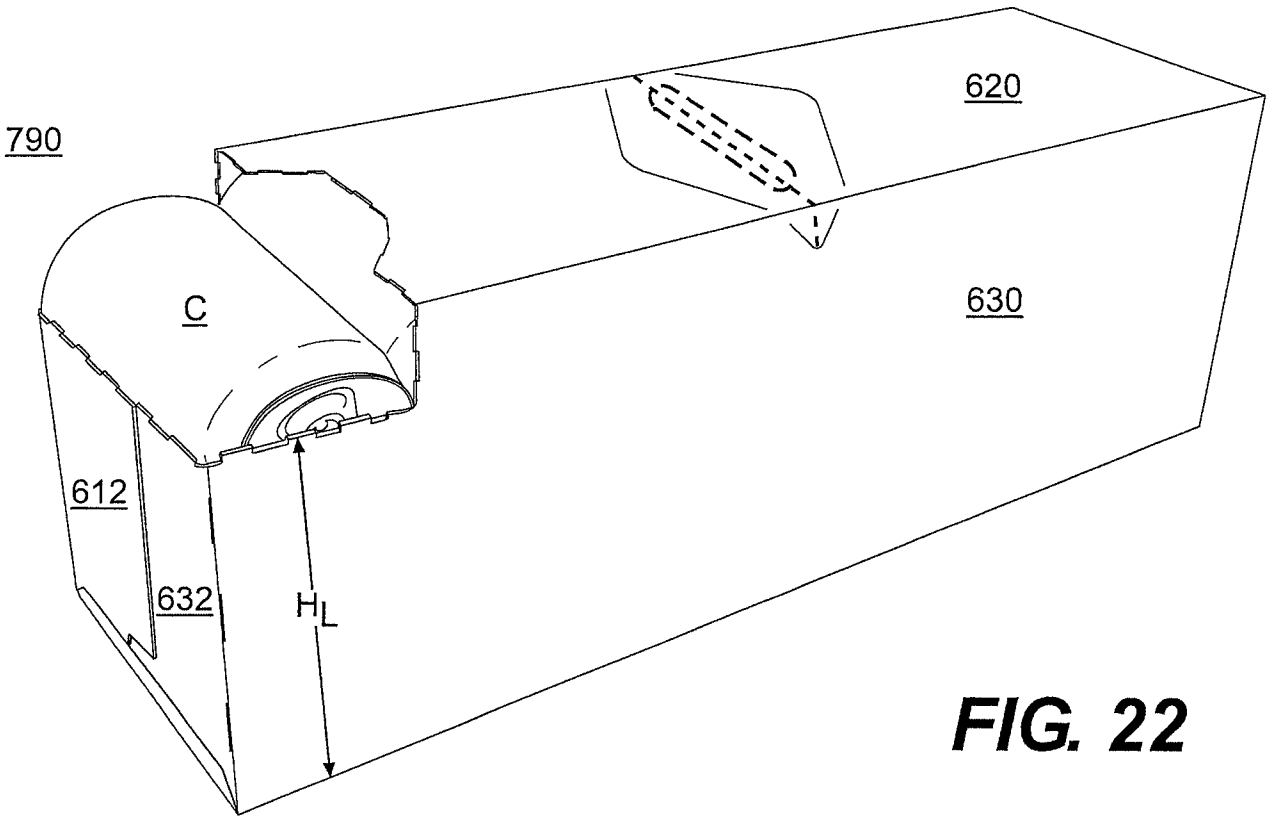
FIG. 22 illustrates the dispenser of the fourth carton embodiment.

FIGS. 20 and 21 are end and partial side views, respectively, of the carton 790. As shown in FIGS. 20 and 21, the edge of the dispenser 780 is disposed at a height $H_L$. The height $H_L$ can be selected to provide access to a column of containers C in the top or uppermost column of containers when the dispenser 780 is opened. FIG. 22 is a perspective view of the dispenser 780 opened. Referring to FIGS. 20-22, the dispenser opening height $H_L$ allows containers C in the top column of containers C adjacent to the exiting end panel 760 to be accessed, while also retaining those containers against inadvertent escape from the carton 790. For example, the height $H_L$ can be in the range of about 105-200% of the container diameter D. In other embodiments, the height $H_L$ can be in the range of about 150-190% of the container diameter D. The distance or depth $D_D$ that the dispenser 780 extends into the side panels 610, 630 can be in the range of about 70-500% of container diameter D to allow access to containers C in multiple rows of containers.

Figure 23:
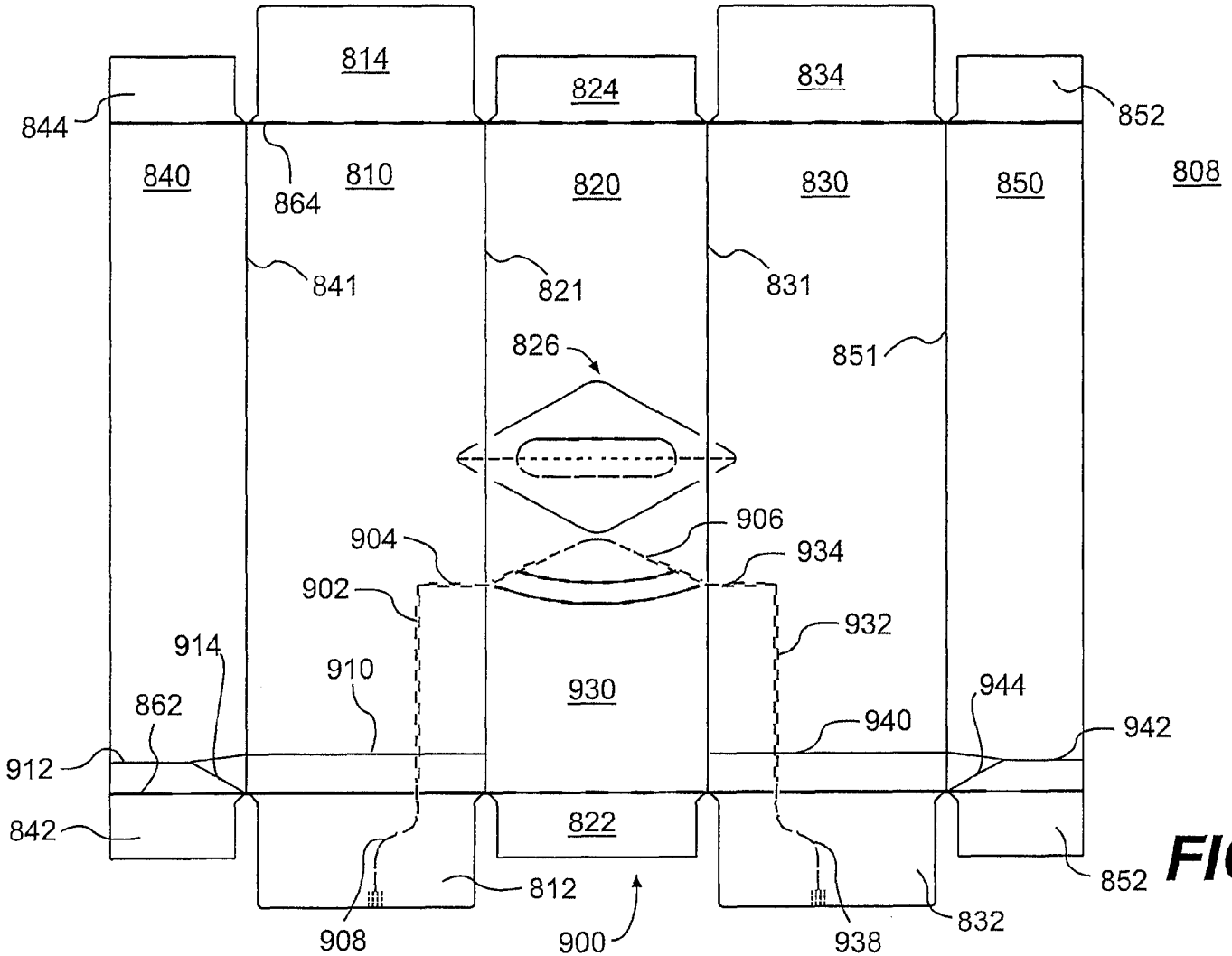
FIG. 23 is a plan view of a blank from which a carton according to a fifth embodiment of the invention is formed.

FIG. 23 is a plan view of a blank 808 used to form a carton 990 (illustrated in FIG. 24) according to a fifth embodiment of the invention. The blank 808 comprises a first side panel 810 foldably connected to a top panel 820 at a first transverse fold line 821, a second side panel 830 foldably connected to the top panel 820 at a second transverse fold line 831, a first bottom panel 840 foldably connected to the first side panel 810 at a third transverse fold line 841, and a second bottom panel 850 foldably connected to the second side panel 830 at a fourth transverse fold line 851. The blank 808 may include a slotted handle 826 in the top panel 820.

The first side panel 810 is foldably connected to a first side exiting end flap 812 and a first side end flap 814. The top panel 820 is foldably connected to a top exiting end flap 822 and a top end flap 824. The second side panel 830 is foldably connected to a second side exiting end flap 832 and a second side end flap 834. The first bottom panel 840 is foldably connected to a first bottom exiting end flap 842 and a first bottom end flap 844. The second bottom panel 850 is foldably connected to a second bottom exiting end flap 852 and a second bottom end flap 854. The exiting end flaps 812, 822, 832, 842, 852 extend along a first marginal area of the blank 808, and may be foldably connected along a first longitudinally extending fold line 862. The end flaps 814, 824, 834, 844, 854 extend along a second or bottom marginal area of the blank 808, and may be foldably connected along a longitudinally extending fold line 864. The longitudinal fold lines 862, 864 may be straight fold lines, or may be offset at one or more locations to account for, for example, blank thickness. When the carton 990 is erected, the exiting end flaps 812, 822, 832, 842, 852 close a front or exiting end of the carton 990, and the end flaps 814, 824, 834, 844, 854 close a back end of the carton 990.

Figure 24:
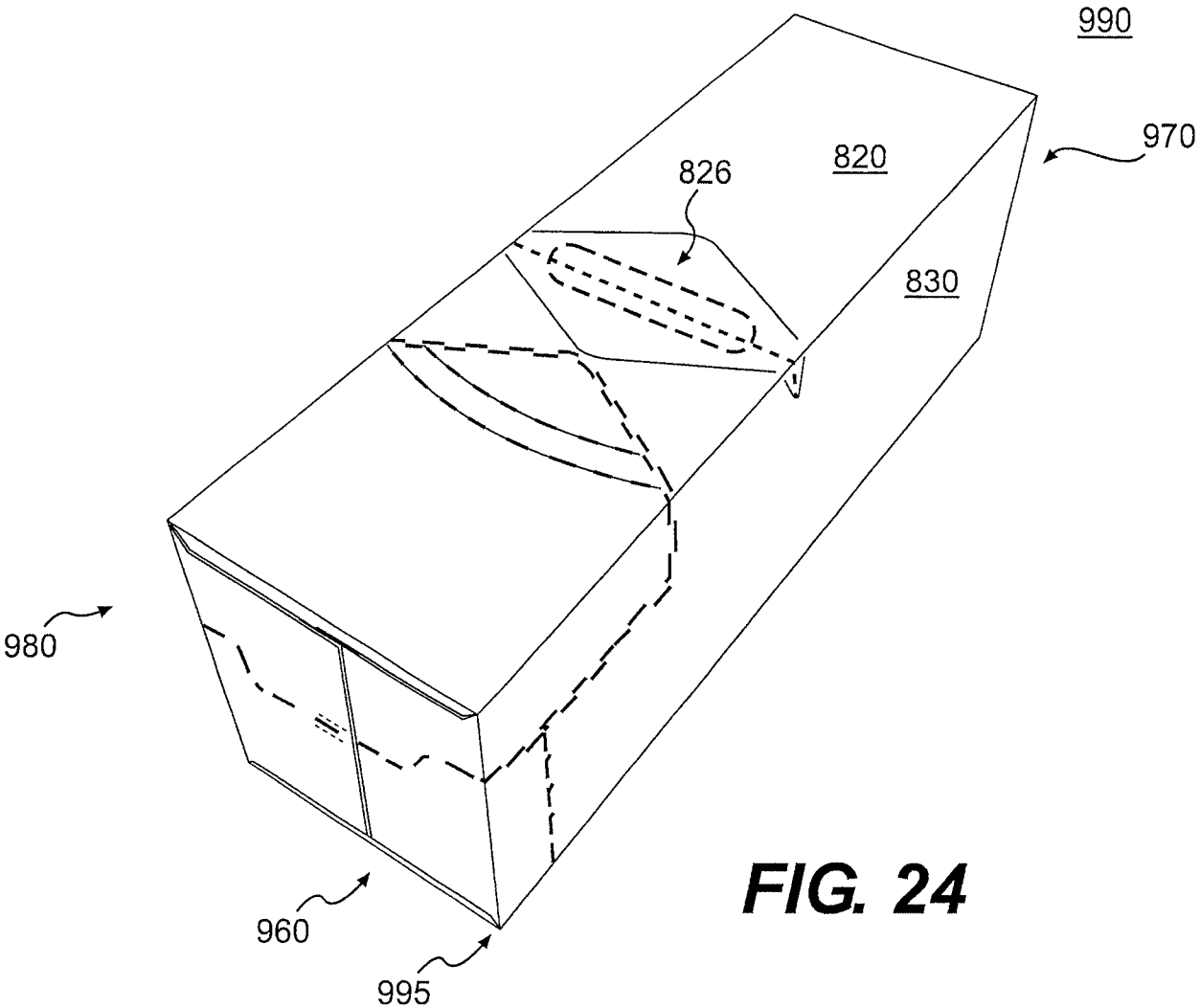
FIG. 24 is a perspective view of the carton according to the fifth embodiment of the invention.

The blank 808 includes a dispenser pattern 900 that defines a dispenser 980 in the erected carton 990 (FIG. 24). The dispenser pattern 900 includes first and second generally transversely extending lines 902, 932, and first and second generally longitudinally extending lines 904, 934. An opening section 906 connects the longitudinally extending lines 904, 934 and provides an opening point for the dispenser 980. A first partially arcuate line 908 extends from an end of the line 902 to the edge of the exiting end flap 812. A second partially arcuate line 938 extends from an end of the line 932 and to the edge of the exiting end flap 832.

First and second pivot lines 910, 912 extend from the fold line 821 to the edge of the first bottom flap 840. A first oblique pivot line 914 extends from the first pivot line 912 to the intersection of the fold lines 841, 862. Third and fourth pivot lines 940, 942 extend from the fold line 851 to the edge of the bottom flap 850. A second oblique pivot line 944 extends from the third pivot line 942 to the intersection of the fold lines 851, 862. The pivot lines define a pivoting bottom door 995 in the erected carton 990 (FIG. 24).

Figure 25:
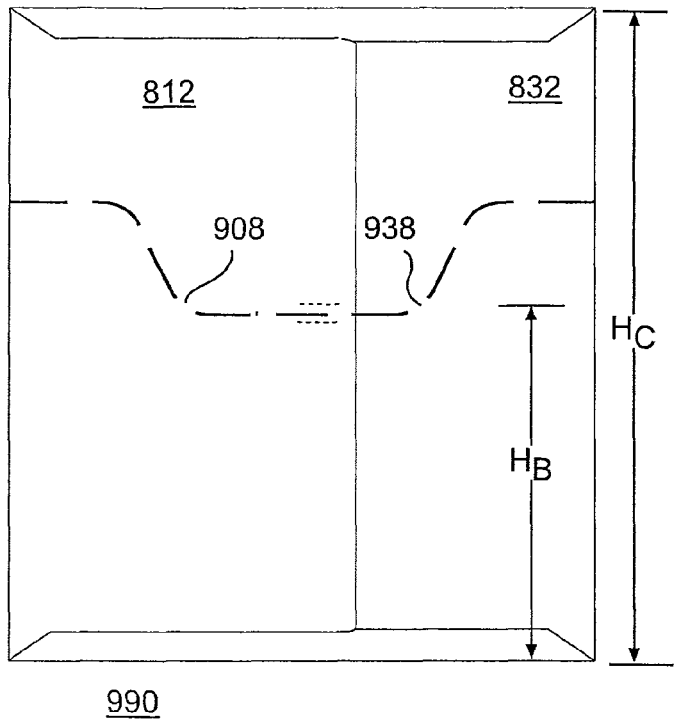
FIG. 25 is an end view of the fifth carton embodiment.
Figure 26:
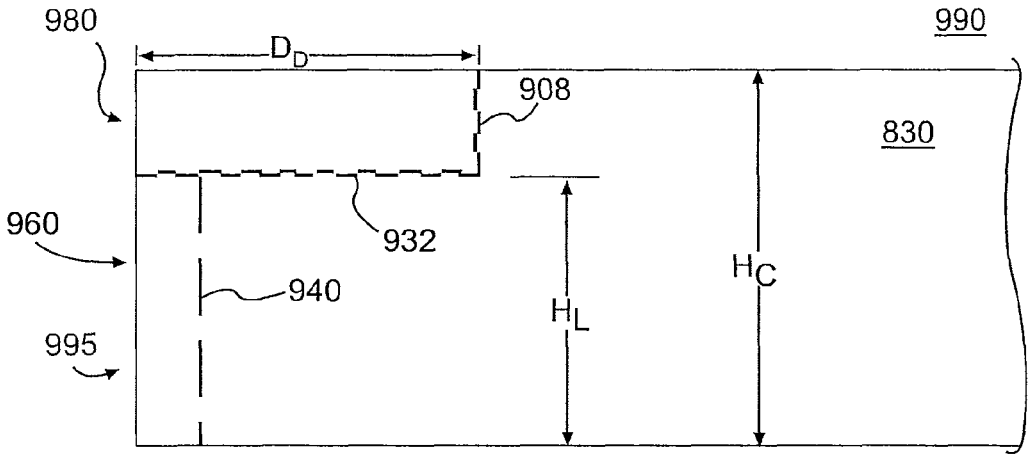
FIG. 26 is a side view of the fifth carton embodiment.

FIG. 24 is a perspective of the carton 990 erected from the blank 808. FIG. 25 is an end view of the carton 990, and FIG. 26 is a side view of the carton. As shown in FIG. 25, the partially arcuate lines 908, 938 extend downwardly to a height $H_B$ in the exiting end panel 960. Referring to FIG. 26, the line 932 and the line 902 (FIG. 23) in the side panels 830, 810 are disposed at a height of $H_L$ in their respective side panels 810, 830. The dispenser 980 may extend a depth $D_D$ into the side panel 810, 830.

Figure 27:
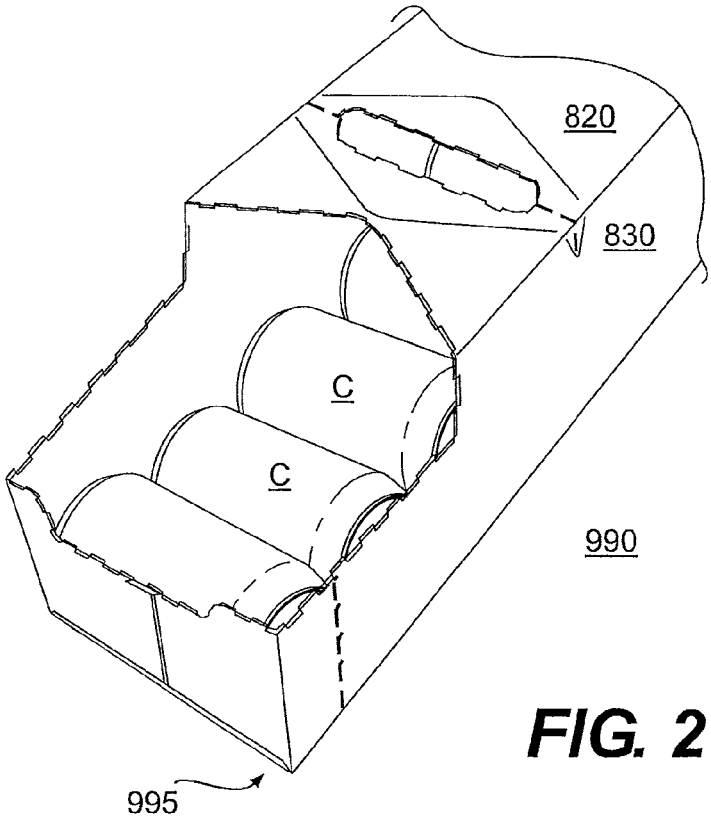
FIGS. 27-28 illustrate opening of the dispenser of the fifth carton embodiment.
Figure 28:
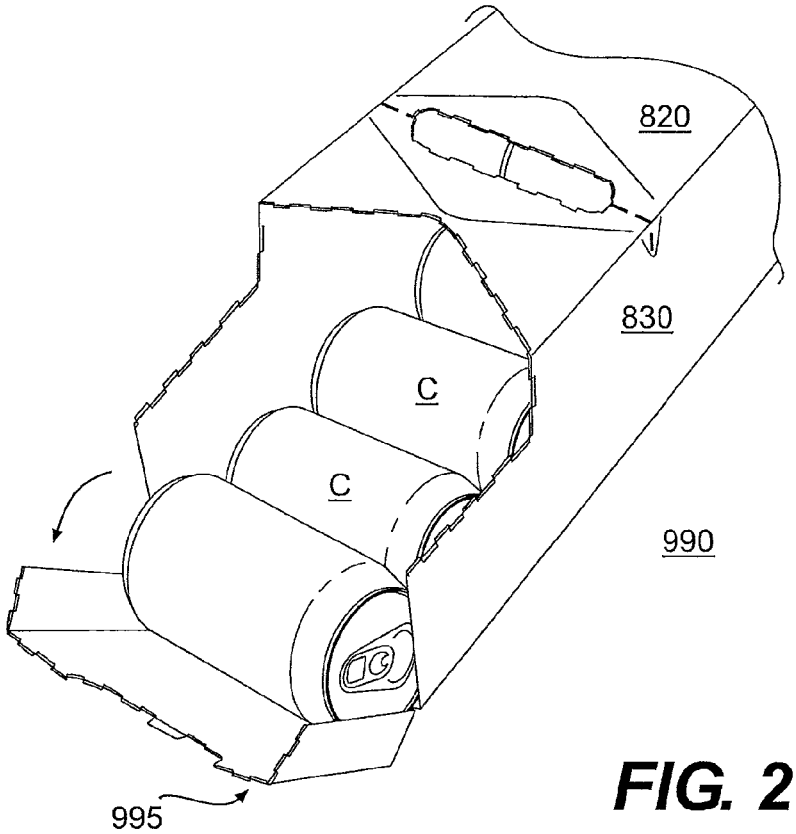

FIG. 27 illustrates the carton 990 partially opened, before pivoting the bottom door 995 open. FIG. 28 illustrates the bottom door 995 pivoted open. The bottom door 995 is pivoted open by partially separating the pivoting bottom door 995 from the remainder of the carton 990 along the lines 910, 914 and 940, 944 (shown in FIG. 23). The lines 910, 914 and 940, 944 can be, for example, continuous cuts or a cut interspersed with nicks to provide for easy pivoting of the bottom door 995. The lines 912, 942 can be fold lines about which the bottom door 995 is now pivotable.

In the above embodiments, the cartons are shown as accommodating generally cylindrical 12 ounce beverage cans. Other types of articles, however, can be accommodated within cartons according to the present invention. These articles can include beverage containers such as bottles and PET containers, as well as other containers cylindrical in shape, such as those used in packaging foodstuffs.

In this specification, the term "pivot" is not intended to limit the embodiments to pivoting about perfectly straight hinge lines. A pivot according to the present embodiment in instead construed to allow for bending or bowing in the bottom panels of the cartons, which still allows for hinged rotation of the bottom doors.

For purposes of illustration, the present invention as disclosed in the paperboard carton, sized and dimensioned to contain 12 articles in a 2×6 configuration, although the present invention is not limited to any specific size or dimension. For example, the present invention would work satisfactorily if sized and shaped to hold articles of other configurations, such as 3×4, 4×3, 2×4, 2×5, 4×6, 4×5, 3×6, 5×6, etc.

In the exemplary embodiments discussed above, the blanks may be formed from clay coated newsprint (CCN). In general, the blanks may be constructed of paperboard, having a caliper of at least about 14, so that it is heavier and more rigid than ordinary paper. The blanks, and thus the cartons, can also be constructed of other materials, such as cardboard, or any other material having properties suitable for enabling the carton to function at least generally as described above. The first and second sides of the blanks can be coated with, for example, a clay coating. The clay coating may then be printed over with product, advertising, and other information or images. The blanks may then be coated with a varnish to protect any information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

A tear line can be any substantially linear, although not necessarily straight, form of weakening that facilitates tearing therealong. Specifically, but not for the purpose of narrowing the scope of the present invention, tear lines include: a cut that extends partially into the material along the desired line of weakness, and/or a series of cuts that extend partially into and/or completely through the material along the desired line of weakness, or various combinations of these features. As a more specific example, one type of tear line is in the form of a series of cuts that extend completely through the material, with adjacent cuts being spaced apart slightly so that small somewhat bridge-like pieces of the material (e.g., 'nicks') are defined between adjacent cuts. The nicks are broken during tearing along the tear line. Such a tear line that includes nicks can also be referred to as a cut line, since the nicks typically are a relatively small in relation to the cuts. The term "line" as used herein includes not only straight lines, but also other types of lines such as curved, curvilinear or angularly displaced lines.

In situations where cutting is used to create a fold line, typically the cutting will not be overly extensive in a manner that might cause a reasonable user to incorrectly consider the fold line to be a tear line. In contrast, where nicks are present in a cut line (e.g., tear line), typically the nicks will not be overly large or overly numerous in a manner that might cause a reasonable user to incorrectly consider the subject cut line to be a fold line.

The above embodiments may be described as having one or panels adhered together by glue. The term "glue" is intended to encompass all manner of adhesives commonly used to secure paperboard carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton, comprising:

a plurality of panels forming an interior space of the carton, the plurality of panels comprises a first side panel, at least one top panel, a second side panel, and at least one bottom panel;

an exiting end panel closing the interior space of the carton at an end of the carton;

a dispenser pattern defining a dispenser having a bottom door extending across the exiting end panel, wherein the dispenser pattern comprises a plurality of tear lines that define a removable portion, the removable portion comprising at least a portion of the exiting end panel, the top panel, and at least one of the first side panel and the second side panel, and wherein the dispenser pattern further comprises a pivot line in the bottom panel, a first line extending in the first side panel substantially from a first end of the pivot line, and a second line extending in the second side panel substantially from a second end of the pivot line; and the first line, the second line and the pivot line enabling pivoting of the bottom door about the pivot line.

2. The carton of claim 1 wherein the exiting end panel comprises a first side end flap foldably connected to the first side panel and a second side end flap foldably connected to the second side panel.

3. The carton of claim 2 wherein the plurality of tear lines comprises a first tear line extending across the first side end flap and a second tear line extending across the second side end flap, the first tear line and the second tear line cooperate to form a bottom edge of the removable portion.

4. The carton of claim 3 wherein the first tear line is generally straight and the second tear line is straight.

5. The carton of claim 3 wherein the first tear line has at least one curved portion and the second tear line has at least one curved portion.

6. The carton of claim 3 wherein the first tear line extends into the first side panel and the second tear line extends into the second side panel.

7. The carton of claim 6 wherein the plurality of tear lines comprises a third tear line extending across the at least one top panel, the third tear line extending into at least one of the first side panel and the second side panel.

8. The carton of claim 7 wherein the at least one top panel comprises a first top panel and a second top panel, the third tear line is in the first top panel and extends into the first side panel, the carton further comprises a fourth tear line in the second top panel that extends into the second side panel.

9. The carton of claim 8 wherein the third tear line intersects the first tear line in the first side panel and the fourth tear line intersects the second tear line in the second side panel.

10. The carton of claim 7 wherein the third tear line extends into the first side panel and intersects the first tear line in the first side panel and the third tear line extends into the second side panel and intersects the second tear line in the second side panel.

11. The carton of claim 10 wherein the third tear line includes at least one oblique portion in the at least one top panel.

12. The carton of claim 1, wherein the first line is a first oblique line and the second line is a second oblique line, the first oblique line and the second oblique line being oblique relative to the tear line.

13. The carton of claim 1, wherein the first line is a first straight line and the second line is a second straight line, the first straight line and the second straight line being generally perpendicular to the tear line.

14. The carton of claim 1, wherein the exiting end panel comprises a top end flap foldably connected to the top panel and the removable portion comprises the entire top end flap.

15. A blank for forming a carton, comprising:

a plurality of panels for forming an interior space of the carton, the plurality of panels comprises a first side panel, at least one top panel, a second side panel, and at least one bottom panel;

at least one end flap foldably connected to at least one panel of the plurality of panels, the end flap is for forming an exiting end panel that closes the interior space of the carton at an end of the carton formed from the blank;

a dispenser pattern for defining a dispenser having a bottom door extending across the at least one end flap, wherein the dispenser pattern comprises a plurality of tear lines that define a removable portion, the removable portion comprising at least a portion of the at least one exiting end flap, the top panel, and at least one of the first side panel and the second side panel, and wherein the dispenser pattern further comprises a pivot line in the bottom panel, a first line extending in the first side panel substantially from a first end of the pivot line, and a second line extending in the second side panel substantially from a second end of the pivot line; and the first line, the second line and the pivot line are for enabling pivoting of the bottom door about the pivot line.

16. The blank of claim 15 wherein the at least one end flap comprises a first side end flap foldably connected to the first side panel and a second side end flap foldably connected to the second side panel.

17. The blank of claim 16 wherein the plurality of tear lines comprises a first tear line extending across the first side end flap and a second tear line extending across the second side end flap, the first tear line and the second tear line cooperate to form a bottom edge of the removable portion.

18. The blank of claim 17 wherein the first tear line is generally straight and the second tear line is straight.

19. The blank of claim 17 wherein the first tear line has at least one curved portion and the second tear line has at least one curved portion.

20. The blank of claim 17 wherein the first tear line extends into the first side panel and the second tear line extends into the second side panel.

21. The blank claim 20 wherein the plurality of tear lines comprises a third tear line extending across the at least one top panel, the third tear line extending into at least one of the first side panel and the second side panel.

22. The blank of claim 21 wherein the at least one top panel comprises a first top panel and a second top panel, the third tear line is in the first top panel and extends into the first side panel, the blank further comprises a fourth tear line in the second top panel that extends into the second side panel.

23. The blank of claim 22 wherein the third tear line intersects the first tear line in the first side panel and the fourth tear line intersects the second tear line in the second side panel.

24. The blank of claim 21 wherein the third tear line extends into the first side panel and intersects the first tear line in the first side panel and the third tear line extends into the second side panel and intersects the second tear line in the second side panel.

25. The blank of claim 24 wherein the third tear line includes at least one oblique portion in the at least one top panel.

26. The blank of claim 15 wherein the first line is a first oblique line and the second line is a second oblique line, the first oblique line and the second oblique line being oblique relative to the tear line.

27. The blank of claim 15 wherein the first line is a first straight line and the second line is a second straight line, the first straight line and the second straight line being generally perpendicular to the tear line.

28. The blank of claim 15 wherein the exiting end panel comprises a top end flap foldably connected to the top panel and the removable portion comprises the entire top end flap.

* * * * *